US006114660A

United States Patent [19]

Donaldson et al.

[11] Patent Number: 6,114,660

[45] Date of Patent: Sep. 5, 2000

[54] PHOTOTHERMOGRAPHIC ELEMENT PROCESSOR WITH FLAPS

[75] Inventors: Eric J. Donaldson, St. Paul, Minn.; Duane A. Preszler, River Falls, Wis.

[73] Assignee: Eastman Kodak Company, Rochester, N.Y.

[21] Appl. No.: 09/207,093

[22] Filed: Dec. 7, 1998

[51] Int. Cl.[7] ..... G03G 15/20; G03G 9/00

[52] U.S. Cl. ..... 219/216; 347/156

[58] Field of Search ..... 219/216, 388, 219/469; 399/148, 149, 222, 285, 286; 347/154, 156, 204, 262; 430/350, 353

[56] References Cited

U.S. PATENT DOCUMENTS

| | | | |
|---|---|---|---|
| 3,739,143 | 6/1973 | Amundson et al. | 219/216 |
| 4,518,845 | 5/1985 | Svendsen | 219/216 |
| 5,132,726 | 7/1992 | Yokota et al. | 355/100 |
| 5,790,069 | 8/1998 | McDaniel et al. | 347/156 |
| 5,826,128 | 10/1998 | Nishida | 396/572 |
| 5,946,025 | 8/1999 | Allen | 347/262 |

FOREIGN PATENT DOCUMENTS

| | | |
|---|---|---|
| 3428361 | 2/1986 | Germany . |

*Primary Examiner*—Joseph Pelham
*Attorney, Agent, or Firm*—William F. Noval

[57] ABSTRACT

A thermal processor for a thermally developable imaging element including a movable member having a heated surface and a plurality of contact flaps biased toward the heated surface of the member. The plurality of contact flaps can be located immediately adjacent each other and the heated surface and the plurality of contact flaps can be positioned to receive the imaging element therebetween.

32 Claims, 18 Drawing Sheets

PHOTOTHERMOGRAPHIC ELEMENT PROCESSOR WITH FLAPS

FIELD OF THE INVENTION

The invention relates to apparatus, methods, and systems for processing photothermographic elements and, more particularly, to apparatus, methods, and systems for exposing, developing, and cooling photothermographic elements.

BACKGROUND OF THE INVENTION

Photothermography is an established imaging technology. In photothermography, a photothermographic element is processed in two steps. The first step involves exposing the photothermographic element to radiation on an image-wise basis to create a latent image in the photothermographic element. This step is often referred to as imaging. The second step involves heating the photothermographic element to a development temperature for a sufficient period of time to thermally develop the latent image to a visible image. This step is often referred to as developing or, simply, as processing.

Devices and methods for developing are generally known and include contacting the photothermographic element with a heated platen, drum or belt (sometimes referred to as endless belts), blowing heated air onto the photothermographic element, immersing the photothermographic element in a heated inert liquid, and exposing the element to radiant energy of a wavelength to which the element is not photosensitive.

Photothermographic elements developed using these known devices and methods often have an uneven or non-uniform image density, image distortions and/or surface abrasion defects. Non-uniform image density defects occur during the development process due to, for instance, surface variations on the heated member, the presence of foreign matter on the photothermographic element or the heated member, and insufficient allowance for outgassing of volatile materials generated during developing. Image distortions can occur due to uncontrolled dimensional changes in the base of the photothermographic element during heating and/or cooling of the photothermographic element. Surface abrasions or marring occur by dragging the photothermographic element across a stationary component in the heating device. In many applications such as text and line drawings, these defects may be acceptable. However, users of medical, industrial, graphic, and other imaging applications desire uniform and high quality images.

In particular, because many belts can have patterns or seams, the image in the photothermographic elements developed using belts can receive an unacceptable corresponding development pattern or seam mark. While drums can make efficient use of space and can have a surface free of belt patterns and seams, drums require the photothermographic element to follow a curved path which can induce curling. In addition, drums require the photothermographic element to be guided along the curved path which can cause surface marring in the photothermographic element. Furthermore, heating the photothermographic element using many known drum devices or other heating devices can create wrinkles when heating the photothermographic element.

As a result, there is a need for a thermal processor which provides uniform and high quality images. There is also a need to mate such a thermal processor with complementary devices and photothermographic elements to offer apparatus, systems, and methods which together optimize uniformity and image quality.

In addition to uniformity and image quality, there is a need for such a processor and related apparatus, systems, and methods which provide increased throughput rates. The capability to image and develop a variation of format sizes are also desirable features not currently available in high quality photothermography. Although known photothermographic apparatus, systems, and methods do have environmental advantages over wet development systems, there are still significant issues unaddressed.

One approach that has been successful is the system described in U.S. patent application Ser. No. 08/239,709 filed on Apr. 12, 1994. This system employs a series of rollers located about a heated drum. The rollers preferably have a relatively small diameter and are closely spaced to maintain uniform contact between the photothermographic element and the heated surface. The rollers also preferably have low thermal mass to minimize the time required for the system to reach a stable operating condition.

In spite of the successes of that system, the rollers do not provide uniform contact between the leading and trailing edges of the photothermographic elements due to their spacing. In addition, if the systems biasing the rollers against the drum are incorrectly adjusted, the rollers may not rotate and can scratch or mar the back surface of the photothermographic element.

SUMMARY OF THE INVENTION

The present invention addresses and overcomes the problems discussed above by providing a thermal processor, as well as other apparatuses, systems, and methods using or working in conjunction with the thermal processor. Thermal processor systems manufactured according to the present invention incorporate stationary, non-rotating members such as contact flaps to provide pressure between a photothermographic element and a heated surface.

Advantages of using contact flaps to provide the desired pressure include the reduced thermal mass of the contact flaps which contributes to a reduction in the time required for the system to reach operating temperature. The contact flaps are also typically less expensive than, for example, rollers, thereby decreasing the cost of operating the machine. The reduced cost also allows for the contact flaps to be discarded after use, as opposed to cleaned -- thereby reducing machine maintenance. The flexible nature of the preferred contact flaps also allows for continuous contact between the flaps and the photothermographic elements to enhance uniformity in the image development. That continuous contact is provided while also allowing for outgassing of volatile materials from the photothermographic element and expansion/contraction of the materials in the photothermographic elements.

The contact flaps themselves may also incorporate an abrasive surface that can be used to clean the heated surface. Thermal sensors may also be mounted on the back side of the contact flaps to allow for more accurate temperature monitoring of the back side of the photothermographic elements during processing.

In one aspect, the present invention provides a thermal processor for thermally developing an image in a photothermographic element moving at a transport rate, the thermal processor including a movable member having a heated surface; a plurality of contact flaps biased against the heated surface of the member, the plurality of contact flaps being located immediately adjacent each other, the heated surface and the plurality of contact flaps being positioned to receive the photothermographic element therebetween, wherein the heated surface is movable in a transport direction at the transport rate of the photothermographic element such that the photothermographic element is heated to at least a threshold temperature for a dwell time sufficient to develop the image in the photothermographic element.

In another aspect, the present invention provides an apparatus, adapted to be used with a photothermographic element sensitive to radiation, for converting data to an image corresponding to the data on the photothermographic element, wherein the photothermographic element is transported at a transport rate, and wherein the apparatus includes an imaging device for converting the data to radiation, and for receiving and exposing the photothermographic element on an image-wise basis to the radiation to create an image in the photothermographic element; and a thermal processor including a moveable heated member positioned to receive the photothermographic element after being exposed by the imaging device and to heat the photothermographic element to at least a threshold development temperature to thermally develop the image in the photothermographic element; a heater thermally connected to the heated member for heating the heated member; and a plurality of contact flaps biased against the heated member, the plurality of contact flaps being located immediately adjacent each other, the heated member and the plurality of contact flaps being positioned to receive the photothermographic element therebetween, wherein the heated member is movable in a transport direction at the transport rate of the photothermographic element such that the photothermographic element is heated to at least a threshold temperature for a dwell time sufficient to develop the image in the photothermographic element.

Still another embodiment includes a thermal processor for thermally developing an image in a thermally developable element having a length. An enclosure has a heated chamber through which the element may be transported. A transporting mechanism may be used to move the element through the heated chamber. A heating system within the heated chamber causes thermal development of the imaging element. Guide flaps position the element within the heated chamber such that heat is transferred uniformly along the length of the element by the heating means.

These and other features and advantages of the present invention are described in connection with illustrative embodiments of the invention below.

DETAILED DESCRIPTION OF THE ILLUSTRATIVE EMBODIMENT OF THE INVENTION

Figure 1:
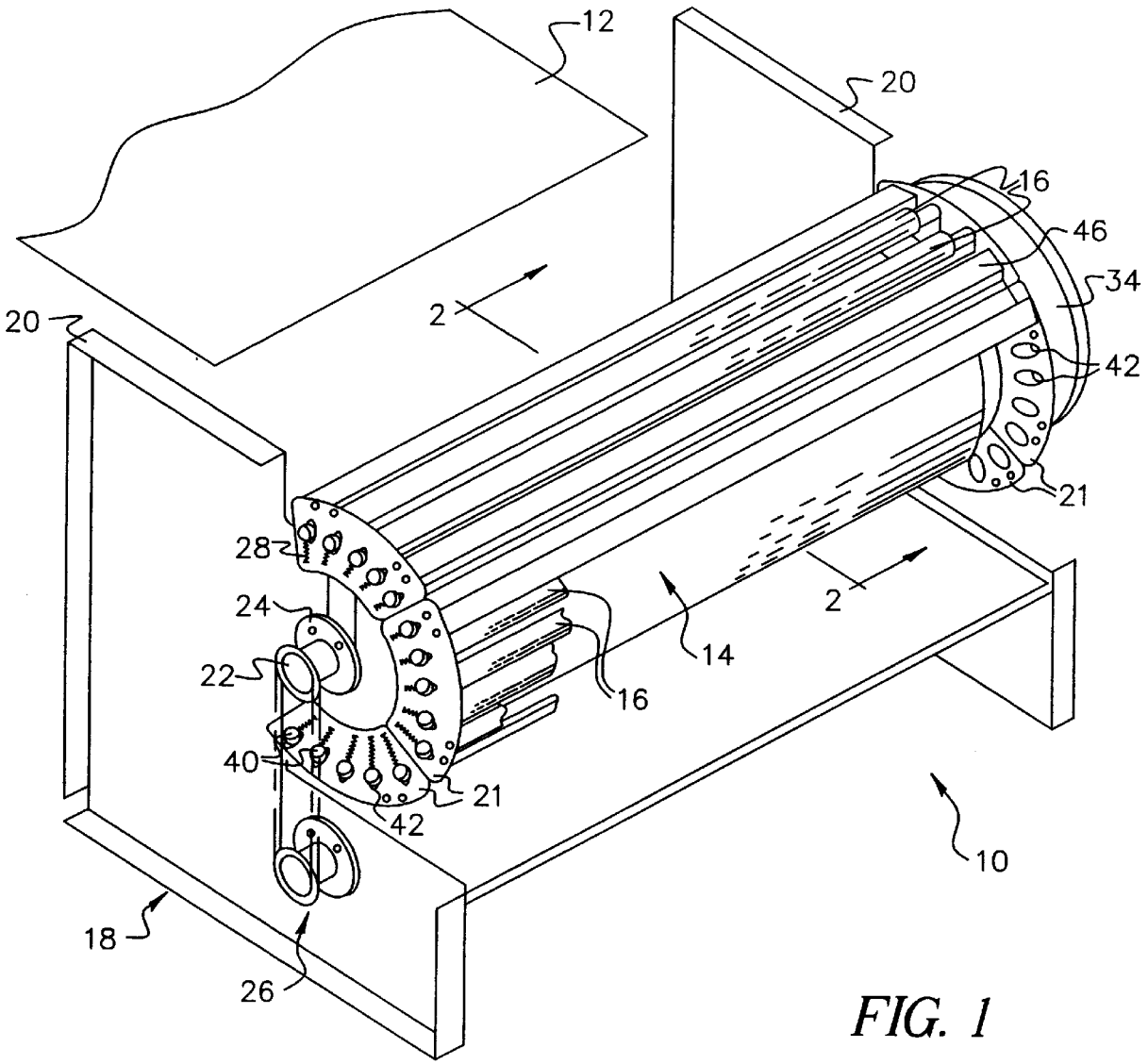
FIG. 1 is a perspective view of one thermal processor.
Figure 2:
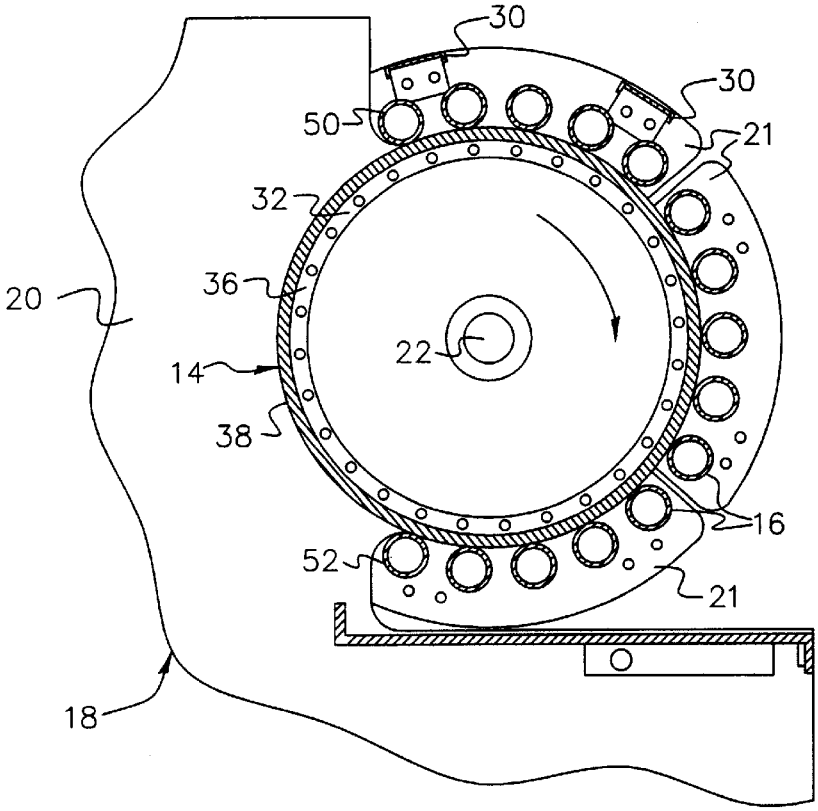
FIG. 2 is a side view of the thermal processor shown in FIG. 1.
Figure 3:
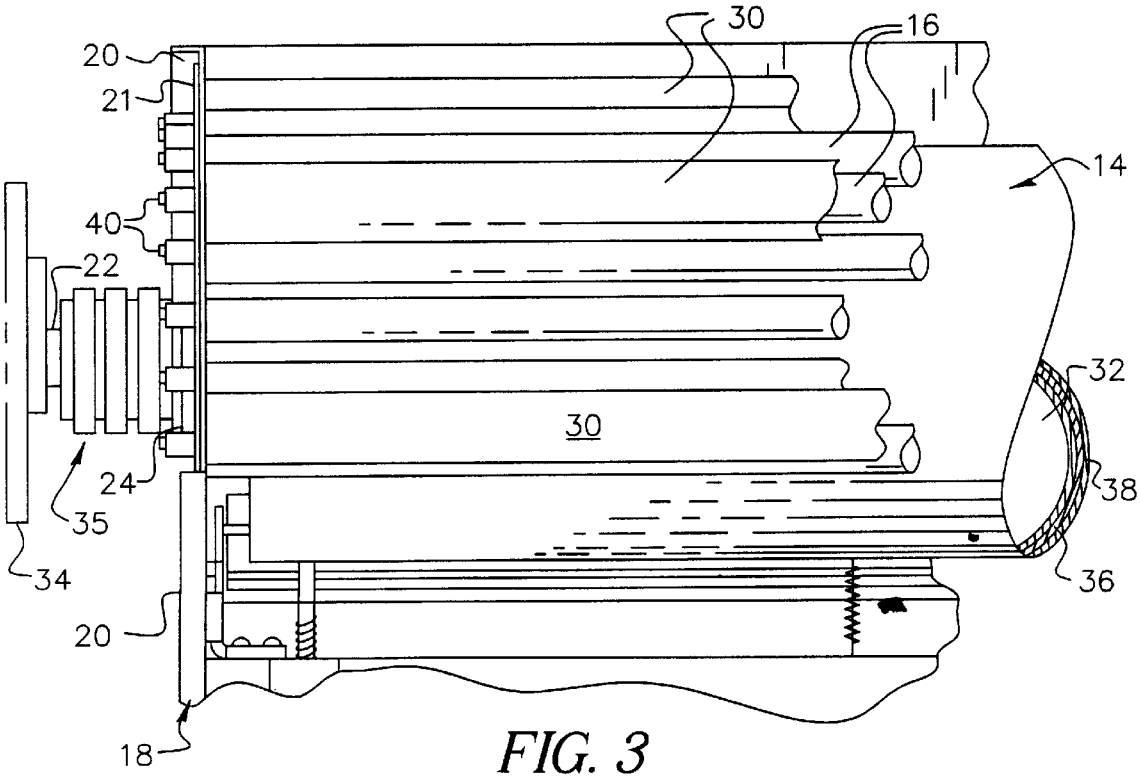
FIG. 3 is a front view of the thermal processor shown in FIGS. 1 and 2.

One thermal processor 10 is shown in FIGS. 1, 2, and 3, for thermally developing imagewise exposed photothermographic elements 12, such as films or paper, either in sheet form or roll form. The thermal processor 10 includes rollers 16 to guide the photothermographic elements 12 around a heated drum as described in U.S. patent application Ser. No. 08/239,709 filed on Apr. 12, 1994, which is hereby incorporated by reference in its entirety. Thermal processors 10 incorporating rollers will be described first for a complete understanding of the development process, after which thermal processors 210 (see FIGS. 16–20) incorporating contact flaps in place of the rollers will be described. It will be understood that the majority of thermal processors adapted for use with rollers can also be used with thermal processors incorporating contact flaps as will be describe d below with respect to FIGS. 16–20.

Thermally developing photothermographic element 12/212 create s a n image by heating the exposed photothermographic element 12/212 to at least a threshold development temperature and for a particular dwell time. The image can be a visible image created from a latent image. The image can also be an image which is readable by an apparatus. The threshold development temperature is the lowest temperature at which a particular photothermographic element begins to develop. Dwell time is the period of time at which a particular photothermographic element should be maintained at or above the threshold development temperature to develop the image in photothermographic element 12/212.

Thermal processors 10/210 can be a stand-alone apparatus used to develop previously imaged photothermographic elements 12/212. Thermal processor 10/210 can, instead, be docked to other apparatus, or it can be an integral component of a multi-function apparatus or system.

Thermal Process or System with Rotatable Guiding Members

Thermal processor 10, shown in FIGS. 1–3, can include moveable heated member 14 and guiding members 16 as shown. Guiding members 16 hold photothermographic element 12 against heated member 14 so that heated member 14 transfers sufficient heat for developing photothermographic element 12. Guiding members 16 can be positioned relative to heated member 14 by processor frame 18. Processor frame 18 is shown to include a pair of processor end members 20 and six guide member brackets 21, three on each of end members 20. Heated member shafts 22 extend from the opposite ends of heated member 14 and are rotatably mounted to end members 20 by shaft bearings 24. Heated member 14 is rotated by a motor (not shown) which is coupled to one of shafts 22 by chain drive mechanism 26, although other mechanisms could be used, such as a gear mechanism driven by a micro-step stepper motor. Guide members 16 are supported in a parallel orientation at circumferentially-spaced positions around the outside of heated member 14 by guiding member brackets 21, and are biased into engagement with heated member 14 by springs 28. Each of guiding member brackets 21 shown has five guiding members 16 mounted thereto. Guiding members 16 extend around about 224 radial degrees of heated member 14 in this embodiment. Cross members 30 are mounted between opposed guiding member brackets 20 for added support. A heater, shown as heater blanket 32, and control electronics 34 have been included to properly heat heated member 14. Electric power is coupled to heater blanket 32 and control electronics 34 through a slip ring assembly 35.

Heated member 14 is shown as being a rotatable cylindrical drum. Other shapes are contemplated. For example, heated member 14 could be a moveable, supported belt having a flat surface so that photothermographic element 12 is flat while being heated. However, cylindrical heated member 14 or heated member 14 having some other type of curved shape can allow for heating of photothermographic element 12 within a limited space. The width of heated member 14 should preferably be chosen to thermally develop the entire width of photothermographic element 12. The diameter of cylindrical heated member 14 should be chosen in conjunction with the desired throughput rate and the desired compactness of thermal processor 10. Similarly, the contact length and shape of an irregularly curved or a flat, supported belt can be chosen based on these considerations.

Heated member 14 shown in FIGS. 1–3 includes aluminum support tube 36 with resilient layer 38 on the exterior of support tube 36. Support tube 36 shown is approximately 18 inches long (45.7 centimeters), 0.25 inch (0.64 centimeters) wall thickness, and has a outer diameter of approximately 6.375 inches (16 centimeters). A larger diameter tube 36, such as 8 inches (20.3 centimeters) and a smaller diameter tube 36, such as 3.5 inches (8.9 centimeters) have also been shown to work. Even larger and smaller sized support tubes could be used. Preferably, the wall thickness of support tube 36 varies by no more than, for example, four percent.

Resilient layer 38 has a sufficiently smooth surface to minimize the formation of patterns on photothermographic element 12 being processed. Preferably, the surface roughness is not more than 250 microinches (6.3 micrometers), and more preferably not more than 125 microinches (3.2 micrometers). On the other hand, the surface roughness for some materials, such as silicone-based materials should not be significantly less than 75 microinches (1.9 micrometers), and more preferably not less than 90 microinches (2.3 micrometers) to prevent photothermographic element 12 from sticking to heated member 14. In addition, a surface roughness of above 90 microinches (2.3 micrometers) allows gases, and particularly, volatile materials, to out-gas more easily from between resilient layer 38 and photothermographic element 12.

The coefficient of static friction between resilient layer 38 and photothermographic element 12 should be sufficiently high in order to grab and transport photothermographic element 12 when nipping the leading edge of photothermographic element 12 with the first of guiding members 16. This coefficient of static friction should be selected to match the force applied by the first of guiding members 16.

Resilient layer 38 is sufficiently thermally conductive to maintain a uniform temperature on the surface of heated member 14 to allow for a practical throughput rate. In one embodiment, resilient layer 38 is preferred to have a thermal conductivity equal to or greater than 4 BTU-inch/hr-ft$^2$-° F. (0.59 Watts/cm$^2$-° C.). This allows thermal processor 10 to thermally develop 8-mil (0.2 millimeters), 14"×17" (35.6 centimeters×43.2 centimeter throughput rate of at least 120 photothermographic elements per hour (heated member diameter of approximately 6.375 inches (16 centimeters); approximately 224 degrees of circumference of heated member 14 in contact with photothermographic element 12). For a similar photothermographic material having a size of 8"×10" (20.3 centimeters×25.4 centimeters), the throughput rate can exceed 200 photographic elements per hour (with same heated member diameter and contact). For a paper-based photothermographic element, the throughput rate using resilient layer 36 can exceed 300-11"×14" (27.9 centimeters×35.6 centimeters) photothermographic elements per hour (with same heated member diameter and contact).

The throughput rate for another size of photothermographic elements relates to that size. Furthermore, increasing the diameter of heated member 14 would allow for higher throughput rates. In addition, throughput rate can be looked as a unit area per unit time (e.g., square centimeters per hour) instead of a number of photothermographic elements 12 per unit time.

In addition to throughput rate, resilient layer 38 allows for an acceptable period of time for warm-up of thermal processor 10. For example, a support tube 36, having an 18-inch long (45.7 centimeters), 0.25 inch (0.64 centimeters) wall thickness, an outer diameter of approximately 6.375 inches (16 centimeters), together with a resilient layer 38, having a thickness of approximately 0.030 inch (0.076 centimeters), is heatable to above approximately 250 degrees Fahrenheit within 20 minutes.

A modeling analysis suggests that the thermal conductivity of the resilient layer has a significant influence on the thermal transfer rate to reach a steady state temperature in a film. This will in turn influence the time required to reach the threshold development temperature as well as the dwell time necessary to fully develop the image in photothermographic element 12. The following one dimensional modeling analysis was performed comparing the temperature variations as a function of time for two different resilient layer conductivity values:

Model Dimensions and Conditions

Resilient layer thickness: 0.030" (0.762 millimeters)

Element base thickness: 0.007" (0.18 millimeters)

Initial element temperature: 70° F. (21.1° C.)

Boundary conditions consisted of fixing a 250° F. (121.1° C.) temperature on the inside edge of the resilient layer 38 and applying a natural convection boundary condition for normal air with a bulk temperature of 70° F. (21.1° C.) on the outside edge of photothermographic element 12. Initial conditions were constructed such that the temperature of resilient layer 38 was at steady state when the 250° F. (121.1° C.) temperature was applied at the inside edge of resilient layer 38 and a natural convection (h=0.88 Btu/hr-ft$^2$-° F.; 0.13 Watts/cm$^2$-° C.) was applied on the outside edge of resilient layer 38 before photothermographic element 12 was introduced.

To capture the transient temperature response correctly, thermal contact resistance was modeled to account for the resilient layer-to-photothermographic element heat transfer by conduction. As developed in the reference (J. P. Holmnan, Heat Transfer, 6th Edition, 1986, McGraw-Hill, Inc., New York, N.Y.), thermal contact resistance through the gap is defined by:

$$1/h_c A$$

where $h_c$ is the contact coefficient and A the total cross sectional area. To simplify the model, $h_c$ was set to:

$$h_c \times 0.20\ K_{air}/T_{film}/100$$

where $K_{air}$ is the conductivity of the air and $T_{film}$ is the photothermographic element thickness.

Figure 4:
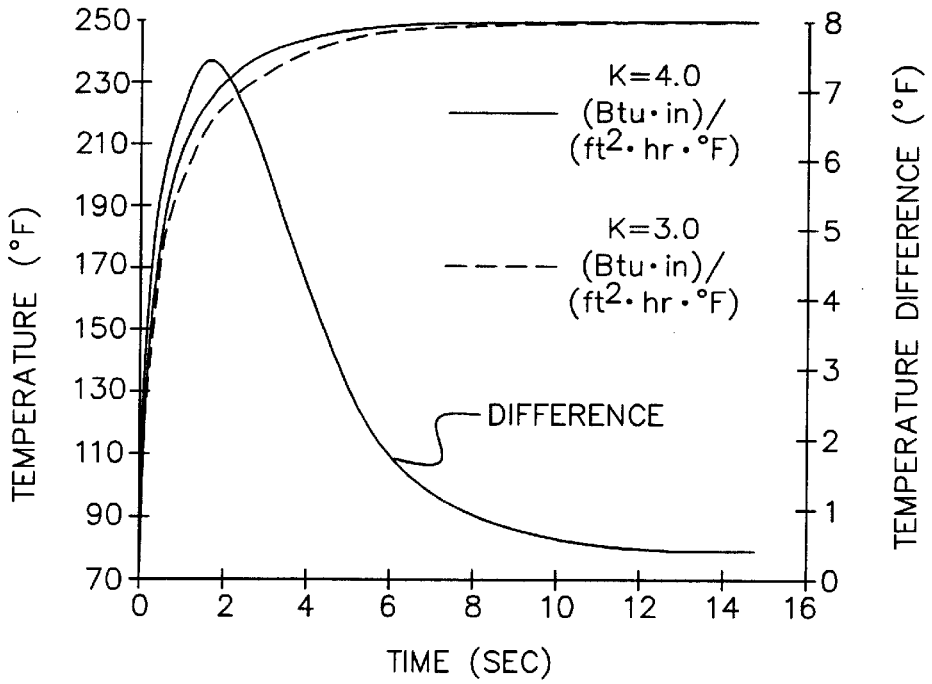
FIG. 4 is a graph showing the effect of different thermal conductivities of a resilient layer within the thermal processor shown in FIGS. 1–3.

FIG. 4 shows a comparison of photothermographic element 12 temperature variation when resilient layer 38 has conductivities of 3.0 and 4.0 BTU-inch/hr-ft$^2$-° F. (0.44 and 0.59 Watts/cm$^2$-° C.). Resilient layer 38 with the higher conductivity showed a faster warm-up response for photothermographic element 12. Photothermographic element 12 with the lower conductivity resilient layer reached 99.9% of its final steady state temperature in approximately 9.65 seconds whereas the higher conductivity silicone took 7.45 seconds. The maximum temperature difference between them was calculated to be 7.40° F. (−13.6° C.).

Figure 5:
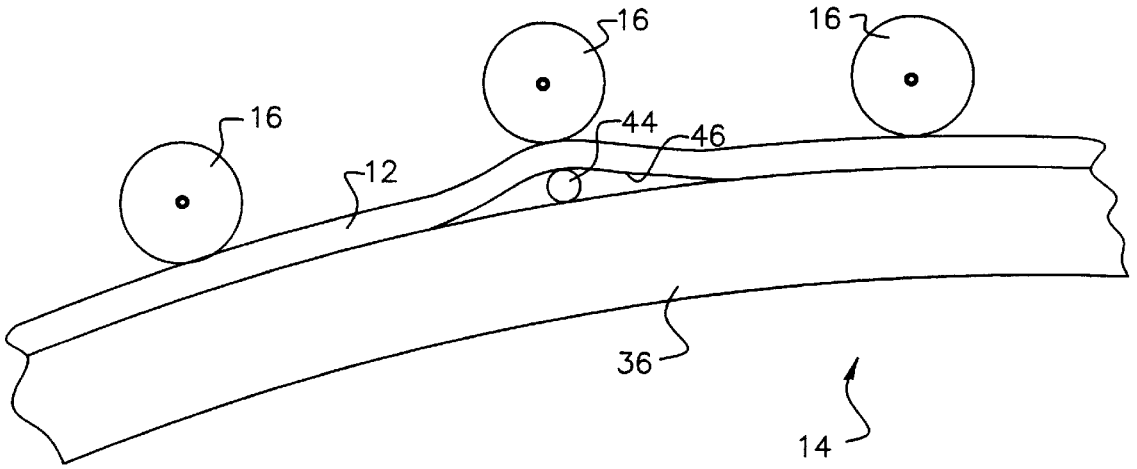
FIG. 5 is a schematic view of an air gap between a photothermographic element and a low resilience heated member caused by the presence of a foreign particle.

In addition to thermal conductivity, the durometer of resilient layer 38 allows thermal processor 10 to develop a high quality image in photothermographic element 12. Trapped foreign particle 44, shown in FIG. 5, between photothermographic element 12 and a low resilience heated member 14 (e.g., aluminum) can cause non-uniform development of the image. Foreign particle 44, if sufficiently large (e.g., >0.001 inch (0.0254 millimeters) in size), causes photothermographic element 12 to be suspended above the surface of heated member 14 creating air gap 46 surrounding particle 44. In this non-contact area, photothermographic element 12 will not receive sufficient heat to fully develop the image thus creating a non-uniform area.

Figure 6:
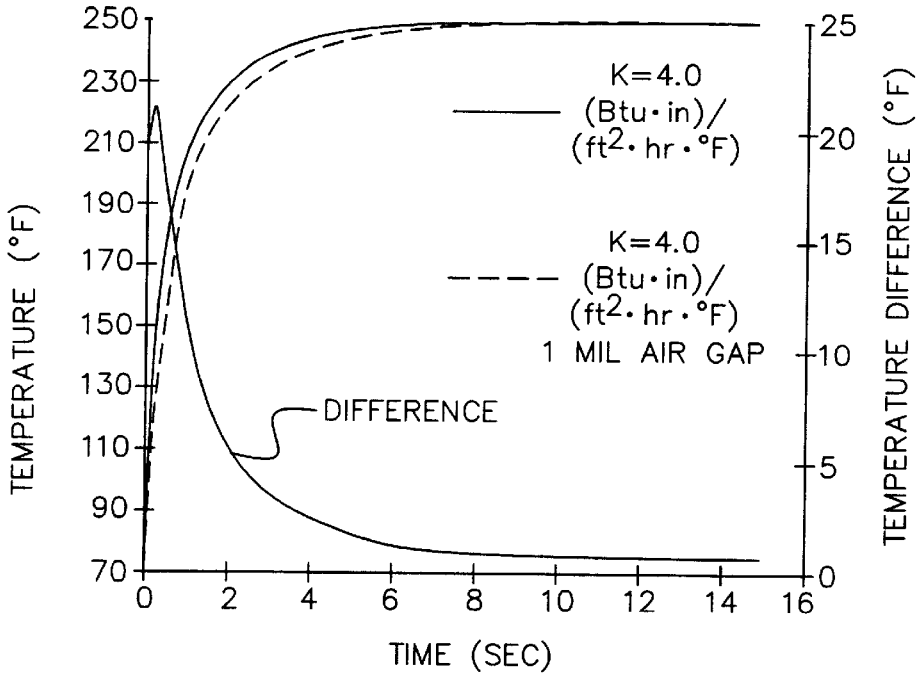
FIG. 6 is a graph showing the effect of an air gap between a photothermographic element and a resilient layer within the thermal processor shown in FIGS. 1–3.
Figure 7:
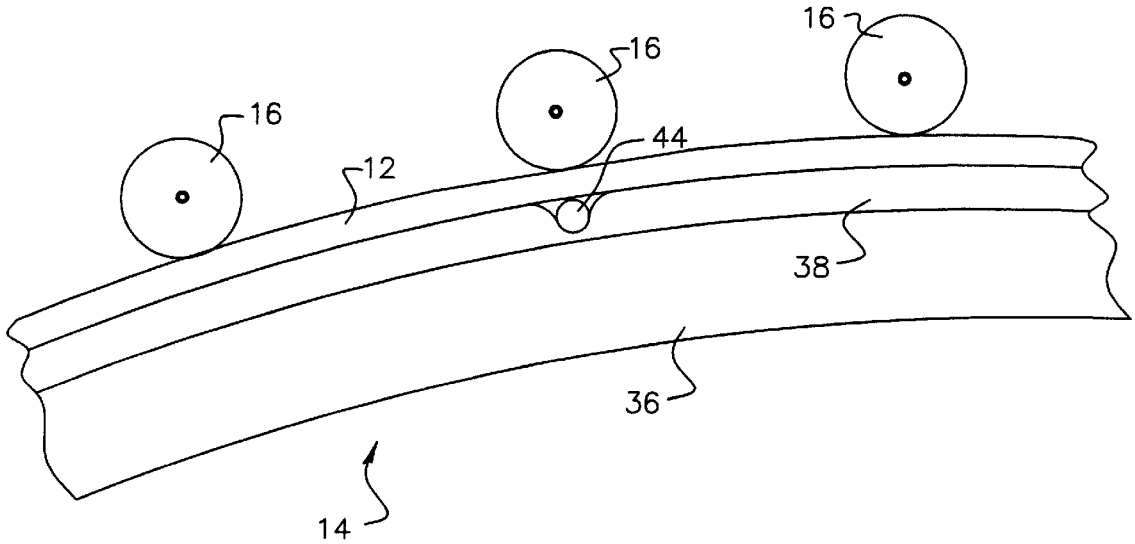
FIG. 7 is a schematic view of a smaller air gap between a photothermographic element and the resilient heated member, shown in FIGS. 1–3, when compared with FIG. 4.

FIG. 6 shows the effect that a 0.001 inch (0.025 millimeter) air gap would have on the heat transfer rate to photothermographic element 12 using the theoretical modeling analysis described earlier. The air gap results show that it took approximately 8.17 seconds to warm up to 99.9% of the element's final steady state temperature. As shown in FIG. 7, this defect can be reduced or eliminated by using resilient layer 38 on heated member 14 which allows particle 44 to be depressed into resilient layer 38 thus allowing more uniform contact with photothermographic element 12.

Larger particles 44, such as those having a size greater than 0.010 (0.25 millimeters) or even 0.050 inch (1.27 millimeters), can be depressed within resilient layer 38, thereby reducing the image defect. However, the ability to completely eliminate a visible defect decreases when the particle size approaches this size. In this case, the presence of particles 44 of this size can be reduced by other means, such as a proper enclosure surrounding thermal processor 10 and an internal filtering system.

Resilient layer 38 provides sufficient depressibility without sacrificing wear resistance. Resilient layer 38 has a hardness of preferably less than 70 Shore A durometer, more preferably less than 60 Shore A durometer, and even more preferably less than 55 Shore A durometer. Two particular silicone-containing materials, having a dopant to increase thermal conductivity, have been found to be particularly useful, such as Silicone #10-3040 (X-040) from Robinson Rubber of Minneapolis, Minn., U.S.A., or W852 from Winfield Industries, Inc., Buffalo, N.Y., U.S.A.

Although the silicone within these materials has a relatively low thermal conductivity, the silicone provides the depressibility and durability. Other base materials could be substituted. Sufficient dopant is added to obtain a thermal conductivity to maximize the throughput rate. The amount of dopant added, however, is balanced to optimize thermal conductivity for throughput rate, depressibility for defect reduction, and durability for wear resistance. Silicone containing materials have the added advantage of providing release properties and chemical inertness to photothermographic element 12.

The dopant can also provide greater electrical conductivity to resilient layer 38. This is useful for handling static build-up in the resilient layer 38.

The thickness of resilient layer 38 is such that sufficient defect reduction can be achieved without significantly affecting throughput rate. The thickness of resilient layer 38 is preferably between 0.010 and 0.060 inch (0.25 and 1.5 millimeters). An even thinner resilient layer 38 is feasible, but the ability to reduce defects by a thinner layer and the manufacturability of a thinner layer should be considered. For the doped silicone material previously mentioned, the thickness may be preferably between 0.025 and 0.040 inch (0.64 and 1.0 millimeters), and more preferably between 0.027 and 0.033 inch (0.69 and 0.84 millimeters) to provide the balance of defect reduction and throughput rate. In addition, the thickness of resilient layer 38 preferably varies over the surface area by not more than 20%, more preferably by not more than 10%, and even more preferably be not more than 5%. Preferably, the roundness run-out is minimized.

Guiding members 16 shown within this embodiment are rotatable rollers, although other forms of guiding members 16, such as small movable belts could also be used if the effects of belt patterns and seams is eliminated or reduced to acceptable level. Guiding members 16 in one embodiment are aluminum and tubular having an 0.86 inch (2.18 centimeters) outer diameter and 0.04 inch (0.1 centimeter) wall thickness. In another embodiment, guiding members 16 have a 0.93 inch (2.36 centimeters) outer diameter and 0.04 inch (0.1 centimeter) wall thickness. The hollow nature of guiding members 16 helps prevent heat transfer to minimize the heat contributed by guiding members 16 during development. Rather than hollow, guiding members 16 could be solid or filled, but preferably such that they would have minimal thermal mass.

A conductive coating such as nickel plating can be applied to the exterior surface of guiding members 16 to draw static electricity from heated member 14. Guiding member shafts 40 extend into the ends of guide members 16 also extend into elongated openings 42 in guiding member brackets 21 and enable guiding members 16 to freely rotate. Guide member shafts 40 can also be conductive and coupled to ground to provide a discharge path for static electricity that could otherwise build up on guide members 16 or heated member 14. Elongated openings 42 are radially aligned with shafts 22 of heated member 14, enabling guiding members 16 to move toward and away from heated member 14.

Springs 28 couple the ends of each guiding member shaft 40 to guide member brackets 21 to urge guiding members 16 toward heated member 14 and to allow each end of each guiding member 16 to be moveable independent of the other end of guiding member 16. Springs 28 are selected so that each guiding member applies a particular force per inch of width of photothermographic element 12 to photothermographic element 12 when being heated by heated member 14. The force should be sufficiently large to hold photothermographic element 12 against heated member 14 so that a uniform transfer of heat from heated member 14 to photothermographic element 12 allows for uniform development. Without sufficient force, surface imperfections on heated member 14 and/or guiding members 16 as well as imperfections within photothermographic element 12 can cause portions of photothermographic element 12 to receive non-uniform heat transfer and development. Non-uniform heat transfer and developments causes the formation of undesirable development patterns, such as mottle areas.

Insufficient force can also result in guiding members 16 not rotating, in the case of idling guiding members. When this occurs and guiding members 16 still contact photothermographic element 12 when moving over heated member 14, guiding members 16 can scratch photothermographic element 12.

On the other hand, the force applied by each guiding member 16 should not exceed a magnitude which causes pressure markings on photothermographic element 12. The magnitude which causes pressure markings can be dependent on the make-up of the photothermographic element being developed. Pressure markings and mottle areas are examples of unacceptable defects for those seeking image uniformity.

In addition, the spring force provided by each of the springs 28 when used in guiding members 16 positioned around cylindrical drum-type heated member 14 shown, can be chosen to compensate for the force of gravity on each of guiding members 16. For example, a spring 30, which is biasing guiding member 16 resting on top of heated member 14, requires less spring force to apply the same total force to photothermographic element 12 than does another spring 30, which is biasing guiding member 16 upwardly against the bottom of heated member 14.

To reduce or eliminate pressure marking defects while also reducing or eliminating mottle-type defects, and other pressure-related defects, one embodiment can be constructed so that the force applied to photothermographic element 12 by each guiding member 16 ranges from 7.2 to 200 grams per centimeter of width of a photothermographic element 12. More preferably, the force should range between 7.2 to 100 grams per centimeter of width of photothermographic element 12. Even more preferably, the force should range between 14 and 30 grams per centimeter of width of photothermographic element 12. In addition, the preferred force within this range depends on balancing the reduction of the mottle-type defects with the pressure marking defects. In some applications, one type of defect may be more undesirable than the other. And the formulation of the photothermographic emulsion of photothermographic element 12 can determine the sensitivity of that particular photothermographic element 12 to insufficient pressure and to excessive pressure.

Applying 7.2 grams per centimeter of photothermographic element 12 was shown to eliminate the pressure marking and mottle defects when an 18-inch (45.7 centimeters) long guiding member 16 applied a total biasing force of 5.58 grams across a 14-inch (35.6 centimeter) wide photothermographic element 12. Applying 73.1 grams per centimeter was also shown to produce no pressure marking and mottle defects, for example, when an 18 inches (45.7 centimeters) long guiding member 16 applied a total biasing force of 44.65 grams across an 11-inch (27.9 centimeter) wide photothermographic element 12. A higher nominal force, such as above 200 grams per centimeter, is feasible. However, the risk of pressure marking defects increases especially when considering the likelihood of force variation during continuous and extended use, and especially when using pressure-sensitive photothermographic elements.

A lower nominal force than previously mentioned is also feasible. However, the risk of mottle defects increases again, especially when considering likely variation from the nominal force. In addition, insufficient force can result in non-rolling guiding member 16 which can further result in surface scratching to photothermographic element 14.

In addition to the force applied by each guiding member 16, the spacing between adjacent guiding members 16 can be important for the development of high quality images on photothermographic element 12. When fed to heated member 14, photothermographic element 12 is generally at room temperature (approximately 70° F., 21.1° C.). To maximize the throughput of thermal processor 10, heated member 14 should quickly heat photothermographic element 12 from room temperature up to at least the threshold development temperature, for example, 200° F. (93.3° C.) in order to begin development.

However, the base material included in some photothermographic elements 12 can experience both thermal expansion and shrinkage (or contraction) when heated, for example, polyester film-based or other thermoplastic-based elements. For uniform dimensional change which prevents wrinkling, photothermographic element 12 should be uniformly heated while being alternated between being unconstrained and being held flat. To do this, multiple guiding members 16 are spaced sufficiently to allow the areas of photothermographic element 12 between the adjacent guiding members 16 to change dimension while not being constrained between guiding members 16 and heated member 14.

But as previously noted, guiding members 16 should hold photothermographic element 12 against heated member 14 for a dwell time in order for sufficient and uniform heat transfer to occur to uniformly develop photothermographic element 12. As a result, the spacing between adjacent guiding members 16 should be chosen so that wrinkling is minimized, but also so that heating of photothermographic element 12 occurs quickly and uniformly.

For curved or cylindrical drum-type heated member 14, adjacent guiding members 16 should be sufficiently close to control the tendency of the leading edge of photothermographic element 12 to straighten when between guiding members 16. This is important in order to keep photothermographic element 12 between guiding members 16 and heated member 14. As shown in FIGS. 1–3, fifteen guiding members 16 are shown positioned around 224 radial degrees of heated member 14, thereby individually spacing 16 radial degrees apart, center to center. This embodiment has been shown to work for relatively stiff photothermographic elements 12, such as those having a 7 mil (0.18 millimeter) polyester film base thickness as well as for less stiff photothermographic elements 12, such as those having a 4 mil (0.10 millimeter) polyester film base thickness when the diameter of heated member 14 is between 3.5 inches (8.9 centimeters) and 8 inches (20.3 centimeters) and the diameter of guiding members 16 is approximately 0.86 inch (2.18 centimeters).

A similar embodiment, where thirty guiding members 16 were used in place of the fifteen (half-spaced), provided greater capture and development of the leading edge of photothermographic element 12. On the other hand, a greater spacing than the above embodiments can be used. The spacing is balanced with the diameter of heated member 14, the thickness of photothermographic element 12, and the heat transfer required. More than three, or more preferably, more than ten guiding members 16 are contemplated to provide sufficient contact of photothermographic element 12 with heated member 14 to achieve development of photothermographic elements 12 at an optimized throughput rate.

The spacing between the first guiding members 16 which contact photothermographic element 12 can be smaller than the spacing between downstream guiding members 16. This arrangement can better hold photothermographic element 12 to heated member 14 when not yet fully heated and still relatively stiff.

Still further, the spacing between adjacent guiding members 16 also allows for additional out-gassing of volatile materials present between heated member 14 and photothermographic element 12. When photothermographic element 12 is heated, as by contact with heated member 14, volatile materials within photothermographic element 12 can create pockets of vaporized material between photothermographic element 12 and heated member 14, causing non-uniform heat transfer. Gases can escape more easily from the portions of photothermographic element 12 located between and unconstrained by adjacent guiding members 16.

Heater blanket 32 is one form of a heater which can be thermally connected to heated member 14 (i.e., capable of heating heated member 14) to heat heated member 14, although others would suffice. An example of heater blanket 32 is a resistive etched foil heater blanket 32 for heating heated member 14. Heater blanket 32 shown can include a number of independently controlled zones (not visible in FIGS. 1–3) to ensure temperature uniformity across heated member 14 where photothermographic element 12 contacts. Heater blanket 32 includes two 1.5 inch (3.8 centimeters) wide zones on the ends of the tube and a 15 inch (38.1 centimeters) wide central zone. Each of the zones includes an RTD sensor (also not shown). Heater blankets 32 of this type are commercially available from a number of manufacturers such as Minco, Inc., of Fridley Minn. While this embodiment refers to three heated zones, it is contemplated that fewer or greater zones could be used as long as temperature uniformity is satisfactory. In addition, while the temperature across heated member 14 which photothermographic element 12 passes and contacts (i.e., cross-web temperature uniformity) should be uniform, heated member 14 can be constructed and/or controlled in a way to create desirable temperature differential between circumferential portions of heated member 14 (i.e., downweb temperature non-uniformity). Alternatively, heated member 14 can be shaped and/or controlled in a way to create downweb temperature uniformity.

Heater control electronics 34 can rotate with heated member 14 and regulate the supply of electrical power to heater blanket 32 in response to sensed temperature information. Heater blanket 32 and control electronics 34 should be capable of attaining and maintaining a range of temperatures on the surface of heated member 14 suitable for the development of a particular photothermographic element 12 for which thermal processor 10 is configured. In one embodiment, heater blanket 32 and control electronics 34 can heat heated member 14 to temperatures between 60° C. and 160° C. (140° F. and 320° F.), and should maintain the temperature across the heated member to within 5° F. (2.78° C.), and more preferably to within 2° F. (1.1° C.), and more preferably to within 1° F. (0.55° C.). For photothermographic elements 12 having a wider thermal latitude, the larger tolerances are allowable.

Use of thermal processor 10 includes feeding undeveloped photothermographic element 12 into the nip formed by heated member 14 and upstream guiding member 16 (i.e., nip 50 in FIG. 2). Photothermographic element 12 having a photothermographic emulsion on one side (or both sides) is developable when fed into thermal processor 10 with either the emulsion side toward or away from resilient layer 38, although it is preferred to have the emulsion side toward resilient layer 38. Photothermographic element 12 then rotates with heated member 14 while guiding members 16 urge photothermographic element 12 toward heated member 14 and keep photothermographic element 12 in contact with heated member 14 for a dwell time during this rotation.

Because guiding members 16 and heated member 14 can move at approximately the same rate as photothermographic element 12 being developed, marring of the surface of photothermographic element 12 is reduced or eliminated. This is important when high quality images are desired.

After being transported between heated member 14 and guiding members 16, developed photothermographic element 12 can be withdrawn from thermal processor 10 as it emerges from the nip formed by the most downstream guiding member 16 and heated member 14 (i.e., nip 52 in FIG. 2).

Thermal processor 10 can be configured to develop various photothermographic elements 12, for example, an infrared sensitized silver halide photothermographic emulsion coated on a 7 mil (0.178 millimeters) polyester film substrate. Heated member 14 is maintained at a temperature of between 240° F. and 280° F. (115.6° C. and 137.8° C.), for example 255° F. (123.9° C.), and rotated at a speed which keeps photothermographic element 12 in contact with heated member 14 for a dwell time of about 15 seconds. With this dwell time and this heated member temperature, photothermographic element 12 can be raised to a temperature of approximately 255° F. (123.9° C.). The thickness and thermal conductivity of resilient layer 38 are chosen to allow for continuous processing of multiple photothermographic elements 12 at a particular throughput rate.

These parameters, of course, can be varied with the particular characteristics of photothermographic element 12 being developed and the throughput goals desired. For example, the temperature and rotation rate of heated member 14 can be varied as well as the dwell time for which photothermographic element 12 contacts heated member 14 in order to develop a photothermographic element 12 having different development requirements. In addition, both heated member 14 and guiding members 16 can have a resilient layer, or guiding members 16 can have a resilient layer while heated member 14 has a less resilient exterior surface. Plus, thermal processor 10 could be reconfigured so that the rotating rollers were heated members 14 and the cylindrical drum or the flat, supported endless belt could act as guiding member 16. It is preferred that the photothermographic emulsion layer of photothermographic element 12 contact resilient layer 38, however, the opposite side of photothermographic element 12 could also be in contact with resilient layer 38. In addition, it is also preferred that the photothermographic emulsion layer of photothermographic element 12 contact heated member 14, however, the opposite side of photothermographic element 12 could also be in contact with heated member 14.

Thermal Processor Systems With Flaps

Figure 16:
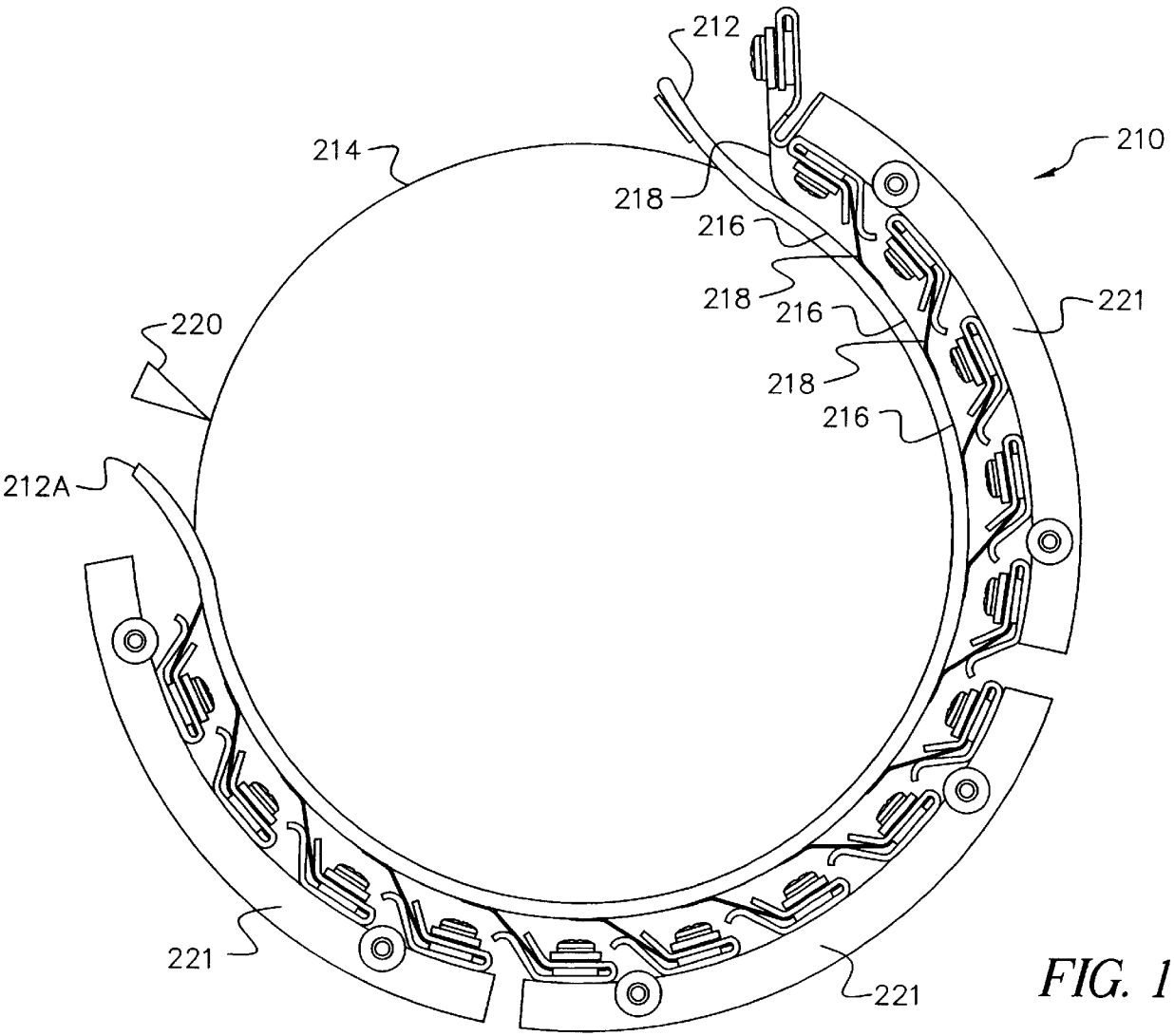
FIG. 16 is an end view of a thermal processor incorporating contact flaps according to the present invention.

In an alternative embodiment, the guiding members 16 of the thermal processor 10 described above can be replaced by a plurality of contact flaps 216 in a thermal processor 210 as seen in FIG. 16, an end view of a portion of one thermal processor 210 incorporating contact flaps 216. As with the guide members 16, contact flaps 216 supply a biasing force for maintaining intimate contact between a photothermographic element 212 and a heated member 214 during development of an image located on the photothermographic element 212. The construction and operation of the heated member 214 is similar to heated member 14 described above and thus will not be further described here.

The photothermographic elements 212 will typically be driven about the heated member 214 by friction between the imaged side of the photothermographic elements 212 and the heated member 214 (because the contact flaps 216 are stationary). It is preferred that the surfaces of the contact flaps 216 biased against the photothermographic element 212 are relatively smooth to enhance the uniformity of the pressure supplied by the contact flaps 216 against the photothermographic element 212, as well as to reduce friction generated between the photothermographic element 212 and contact flaps 216 as the photothermographic element 212 advances past the contact flaps 216. When discussing friction here, it will be understood that it is preferred that the frictional forces generated between the heated member 214 and the photothermographic elements 212 will be greater than any frictional forces generated between the contact flaps 216 and the photothermographic elements 212. As a result of the friction force differential, the photothermographic elements 212 will preferably advance uniformly with the heated member 214.

The plurality of contact flaps 216 are preferably supported in a generally parallel orientation to each other about at least a portion of the circumference of heated member 214 by flap support brackets 221. Like the guide members 16 discussed above, the contact flaps 216 are preferably located around about 224 radial degrees of the heated member 214. As above, heated member 214 is depicted as being a circular cylinder, but it will be understood that other shapes for the heated member 214 are also contemplated.

Also included is a stripping element 220 designed to assist in lifting the leading edge 212*a* of the photothermographic element 212 from the surface of the heated drum 214. The stripping element 220 will typically comprise a knife-edge blade although any structural element suitable for raising the leading edge 212*a* off of the drum 214 could be substituted.

Figure 17:
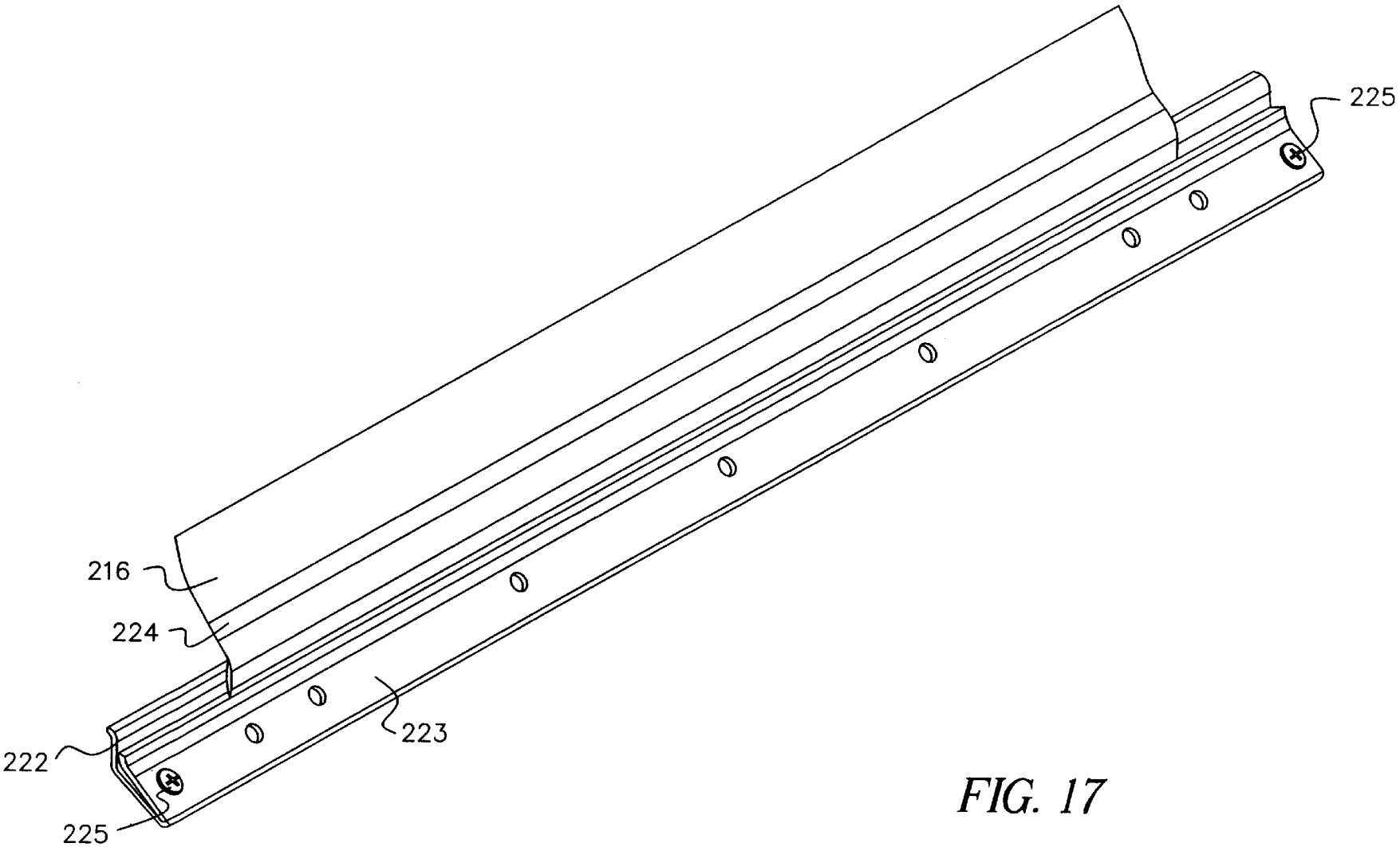
FIG. 17 is an enlarged perspective view of one contact flap and its associated support structure for use in the system of FIG. 16.

FIG. 17 is an enlarged perspective view of one of the contact flaps 216 and its associated support structure. One end of the contact flap 216 is preferably retained between a base support bar 222 and a clamp 223 that are connected to each other by threaded fasteners 225 in the preferred embodiment. Also a part of the preferred support structure is a sleeve 224 into which a portion of the flap is inserted and which provides a curve in the normally planar nature of the preferred contact flap material. The base support bar 222, clamp 223, and sleeve 224 are preferably formed of metal, e.g., stainless steel, although other materials could also be used.

The support structure, i.e., base support bar 222, clamp 223, and sleeve 224 in the preferred embodiment, is used to retain the contact flaps 216 in the desired orientation with respect to the heated member 214. In some cases, the support structure may simply clamp the ends of the contact flaps 216 to retain the flaps in the proper position. It is preferred, however, that the contact flaps 216 be loosely held in position to allow for thermal expansion of the components during use while maintaining even pressure on the photothermographic elements 212 across the width of the contact flaps 216. In the preferred support bars 222 and clamps 223, a plurality of pins are inserted into oversized holes in the contact flaps 216 to effect the loose, yet secure, connection that is desired.

Regardless of the actual support structure used, the contact flaps 216 are preferably held such that they are biased against the surface of the heated member 214 (or a photothermographic element 212 if present) with a uniform force across the width of the heated member 214. In some embodiments, the inherent stiffness of the contact flap 216 will provide sufficient force or pressure against a photothermographic element 212 on the heated member 214 to provide high quality images. To assist in that regard, it is preferred that the contact flaps 216 be made of material or materials that resist permanent deformation during use in the processor 210, although some deformation may be acceptable provided it does not reduce the pressure provided by the contact flap 216 below the point at which high quality images can be provided.

Although the contact flaps 216 may be provided alone, a support flap 218 is provided in the preferred embodiment to assist in biasing each of the contact flaps 216 against the heated member 214 with a desirable, repeatable amount of biasing force over the width of the photothermographic element 212 being processed. The support flaps 218 are also preferably located within the support structure and can best be seen in the enlarged view of FIG. 18. The support flaps 218 are preferably retained in the same manner as are the contact flaps 216, i.e., loose, to allow for thermal expansion.

As discussed above, the actual amount of force applied by the contact flaps 216 should be sufficient to hold photothermographic element 212 against the heated member 214 so that uniform heat transfer from the heated member 214 to the photothermographic element 212 occurs, thereby resulting in uniform development. Without sufficient force, surface imperfections on the heated member 214 and/or imperfections in the photothermographic element 212 can result in non-uniform heat transfer and development. Non-uniform heat transfer can cause the formation of undesirable patterns such as mottle areas. At the other end of the force spectrum, the force provided by the contact flaps 216 should not exceed a magnitude such that the contact flaps 216 cause pressure markings on the photothermographic elements 212.

Another factor to be considered when determining the actual biasing force of the contact flaps 216 is that the base material included in some photothermographic elements 212 can experience both thermal expansion and shrinkage (or contraction) when heated, for example polyester film-based or other thermoplastic-based elements. For uniform dimensional change which prevents wrinkling, photothermographic element 212 should be uniformly heated. To do this, the force with which the contact flaps 216 are biased against the heated member 214 should be low enough to allow the photothermographic element 212 to change dimension without wrinkling or pressure variations large enough to significantly adversely affect image quality.

In the preferred embodiment, each of the plurality of contact flaps 216 are biased against the heated member 214 with a biasing force of about 200 grams per centimeter or less of width of the photothermographic element 212, more preferably about 100 grams per centimeter or less, even more preferably about 50 grams per centimeter or less, and even more preferably about 10 to about 30 grams per centimeter of width of the photothermographic element.

One preferred support flap 218 is made from a sheet of flexible material that is capable of withstanding the heat from the thermal imaging process. It is preferred that the material used for the support flap 218 resist the tendency to permanently deform, or curve, in response to use in the thermal processor 210. The pressure provided by the contact flap 216 will be reduced if the material used in the support flaps 218 deforms permanently after a relatively short period of use, although some deformation is acceptable provided it does not reduce the pressure provided by the contact flap 216 below the point at which high quality images can be provided. It is preferred that the contact flaps 216 are longer than the support flaps 218 such that the photothermographic elements 212 do not contact the support flaps 218 during normal operation.

In the preferred embodiment, the contact flaps 216 and the support flaps 218 are made of the same material, although it will be understood that they could be made of different materials. It should also be understood that the contact flaps 216 and/or support flaps 218 could be provided from a composite of one or more materials providing the desired properties. Examples of suitable materials for the contact flaps 216 and the support flaps 218 include polyimide films (such as KAPTON brand polyimide film, available from E.I. DuPont de Nemours, Wilmington, Del.), polytetrafluoroethylene films (such as TEFLON brand PTFE film, also available from E.I. duPont de Nemours, Wilmington, Del.) and any other material possessing the properties described above. One particularly preferred material for the contact flaps 216 is KAPTON brand film having a nominal thickness of about 0.004–0.007 inch (about 0.1–0.18 mm). In connection with that, the preferred support flaps 218 are also preferably KAPTON brand film with a nominal thickness of about 0.005–0.010 inch (about 0.13–0.25 mm).

Although the polyimide flaps 218 are relatively non-conductive, more conductive flaps could be made by using a more conductive material than polyimide or by doping the polyimide with a conductive additive. Conductive flaps could be grounded such that they minimize the build-up of static electricity.

Figure 18:
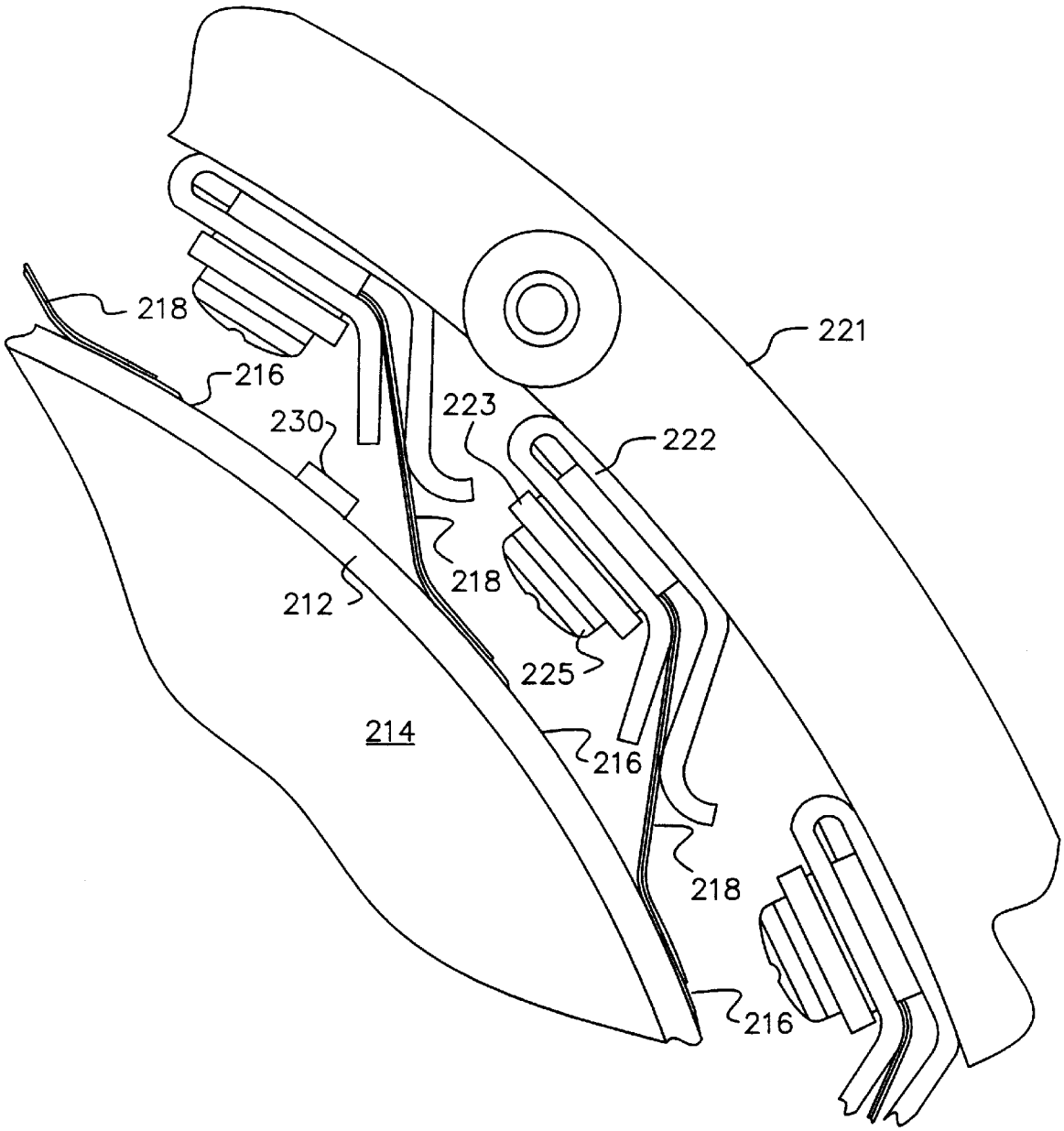
FIG. 18 is an enlarged end view of a plurality of adjacent contact flaps and associated support structure when installed on the system of FIG. 16.

As shown in FIGS. 16 and 18, it is preferred that the contact flaps 216 overlap each other on the surface of the heated member 214. When the contact flaps 216 overlap each other, the uniformity of pressure on the photothermographic element 212 may be improved. In addition, the leading edge of the photothermographic element 212 may not be allowed to lift off of the surface of the heated member 214 which can further improve uniformity of image development at the leading and trailing edges of the photothermographic element 212. Although it is preferred that the contact flaps 216 overlap and are in contact with each other on the surface of the heated member 214, it will be understood that they may not overlap or be in contact with each other in some configurations.

Although the preferred contact flaps 216 and related structure described above have one construction, it will be understood that many other constructions for the contact flaps 216 could be substituted. The primary consideration in providing the contact flaps 216 is that they provide uniform pressure or biasing force against the photothermographic elements being imaged in the processor. The pressure should be relatively uniform transverse to the direction of travel of the photothermographic elements 212 (i.e., across each contact flap 216) as well as about the heated member (i.e., from flap to flap). That uniformity in pressure is required to reduce variations in the processing rate of the thermal processor 210.

One example of an alternative flap includes a composite flap providing the functions of both the support flap 218 and contact flap 216. Such a composite flap could be provided by bonding separate pieces made of the same or different materials, e.g., a metallic spine with a polymer film bonded thereto for contacting the photothermographic elements. In another example, the composite flap could be provided with a varying thickness to provide both functions of the contact flap 216 and support flap 218. In such a construction, the composite flap would typically be thinner where it contacts the photothermographic elements and thicker where attached to the support structure.

Figure 19:
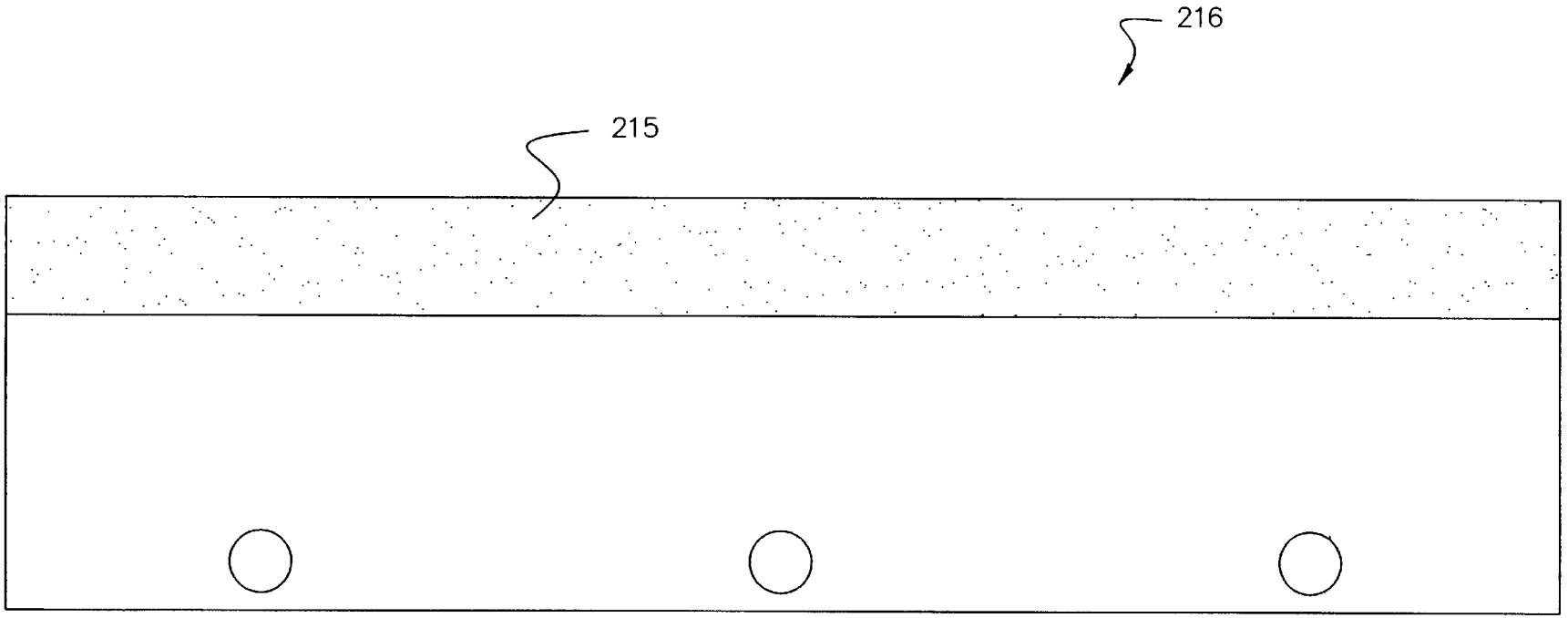
FIG. 19 is a plan view of one contact flap including an abrasive surface.

An additional optional feature that could be incorporated into the contact flaps 216 is an abrasive surface 215 on one side of the contact flaps 216, as shown in FIG. 19. If the abrasive surface 215 is placed in contact with the surface of the heated member 214, that surface can be cleaned by rotating the heated member 214 against the abrasive surface. The abrasive surface 215 may be provided in any suitable manner including, but not limited to abrasive particles, e.g., beads, diamond particles, etc., bonded to the contact flap 216 or a microreplicated structured surface.

Another optional feature also depicted in FIG. 18 could include one or more thermal sensors 230 on the contact flap 216 to sense the temperature in close proximity to the photothermographic element 212 to more accurately gauge the temperature on the surface of the photothermographic element 212. More accurate temperature monitoring can improve the image quality. Suitable thermal sensors 230 could include, for example, thermocouples, resistive thermal devices, thermopiles, etc.

Figure 20:
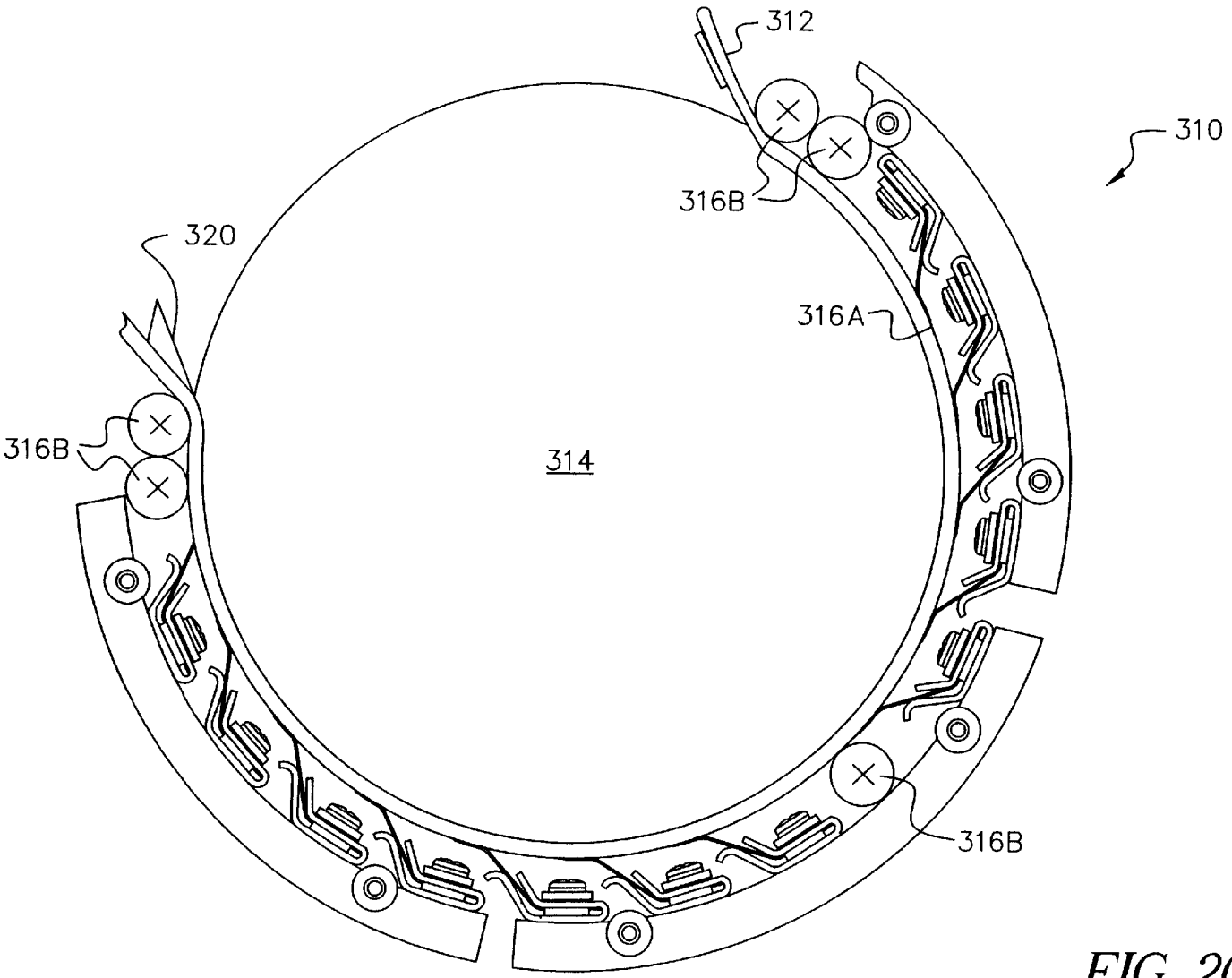
FIG. 20 is an end view of an alternative thermal processor incorporating contact flaps and rolling guide members according to the present invention.

Yet another alternative thermal processor system 310 is depicted in FIG. 20. The system 310 includes a plurality of contact flaps 316*a* used to maintain adequate pressure between the photothermographic element 312 and the surface of the heated member 314. The system 310 may also incorporate one or more rotatable guiding members 316*b* at the initial contact area between the photothermographic element 312 and the heated member 314, as shown in FIG. 20. By including one or more rotatable guiding members 316*b* at the initial contact area, the pressure of the photothermographic element 312 against the heated member 314 can be increased to compensate for the lower temperature before the photothermographic element 312 as the thermal image process begins. The contact flaps 316*a* would be constructed and supported similar to the contact flaps 216 in thermal processor system 210 as discussed above, while the rotatable guiding members 316*b* would typically be constructed and supported as discussed above with respect to guiding members 16 in thermal processor system 10.

In addition to using one or more rotatable guiding members 316*b* at the initial contact area, the guiding members 316*b* could also be located at the exit area where the photothermographic elements 312 are removed from contact with the heated member 314. In another alternative, rotatable guiding members 316*b* could be located between the initial contact area and the exit area, with the guiding members 316*b* being separated by plurality of contact flaps 316*a* to maintain adequate pressure on the photothermographic elements 312.

Figure 21:
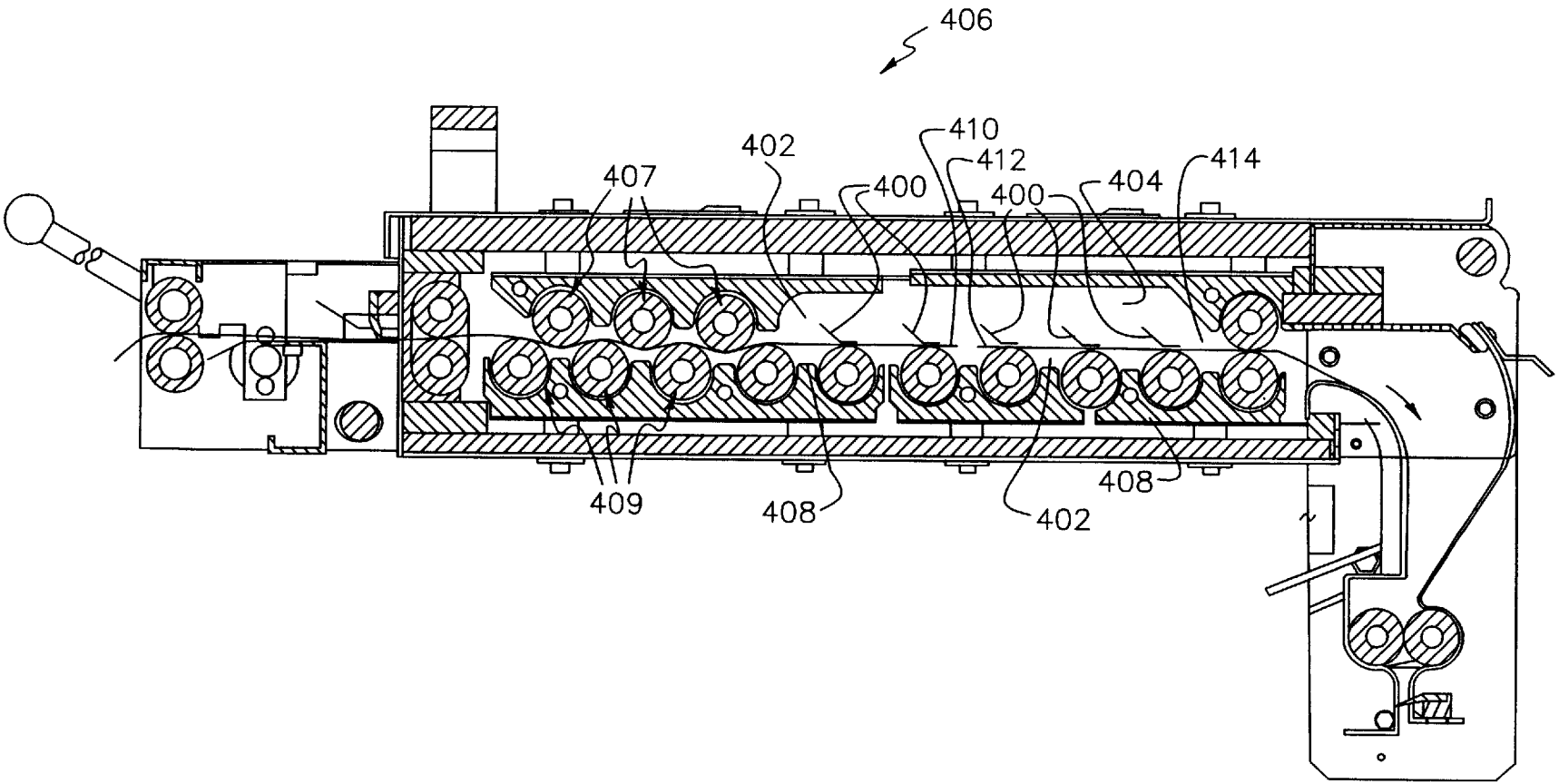
FIG. 21 is a side view of an alternative thermal processor incorporating flaps according to the present invention.

In addition to employing the flaps to hold a thermally-developable element against a heated drum as noted above, flaps can be used with other thermal processors. For example, flaps 400 (similar to those shown in FIG. 20) could hold the elements 402 (two shown) against a moving, heated, endless belt (not shown) or through a heating chamber 404 as generally illustrated in FIG. 21. The thermal processor 406 shown in FIG. 21 is described in greater detail in copending U.S. patent application Ser. No. 08/596,410 filed on Feb. 2, 1997, assigned to Minnesota Mining & Manufacturing, and hereby incorporated by reference. In addition to the positioning of the flaps 400 shown in FIG. 21, the positioning could be such that flaps 400 replace upper rollers 407 and bias the element 402 against the lower rollers 409.

Within a heating chamber (or enclosure) 404, the flaps 400 can be useful to hold an element 402 in a specific location with respect to a heating member or members 408 within the chamber 404. This can cause the heat transfer along the length of an element 402 (i.e., the downweb direction) to be more consistent. Holding or controlling the movement of the leading and/or trailing edges 410, 412 of an element 402 can be particularly important because when these edges are temporarily unsupported, the edges 410, 412 can be more free than the center portion 414 of an element 402 to move to positions within the chamber 404 which causes the edges 410, 412 to receive a different amount of heat than the center portion 414 and thereby be developed differently.

Because edges 410, 412 of an element 402 being heated can more quickly gain and lose heat than the center portion 414, the flaps 400 can be used to position the edges 410, 412 such that the edges 410, 412 are actually further from a particular heated member such that the element is more consistently heated from leading edge to trailing edge. Similarly, flaps or another component can be used to position the side edges of the element such that the side edges (not shown) are positioned further from a heated member 408 such that the element 402 is heated more consistently from side edge to side edge.

Other replacement arrangements are similarly envisioned for flatbed type processors such as processor 406. For example, a significantly larger number of flaps could be employed to provide more control of the element 402, more like the flaps 316*a* shown in FIG. 20 biasing toward the heated drum 314. As another example, all or a number of the upper rollers 407 and lower rollers 409 could be replaced with the flaps 400.

Photothermographic Element Cooling Apparatus

Following thermal development of the image, preferably photothermographic element 12 can be lifted and guided away from the surface of heated member 14 and toward, for example, a cooling apparatus. However, it is important that the structure used to lift and guide photothermographic element 12 cause little or no marring, that is, surface abrasion. In addition, this structure preferably should counteract the curling tendency of photothermographic element 12 after being heated on the curved surface of a heated member 14 as discussed above.

Figure 8:
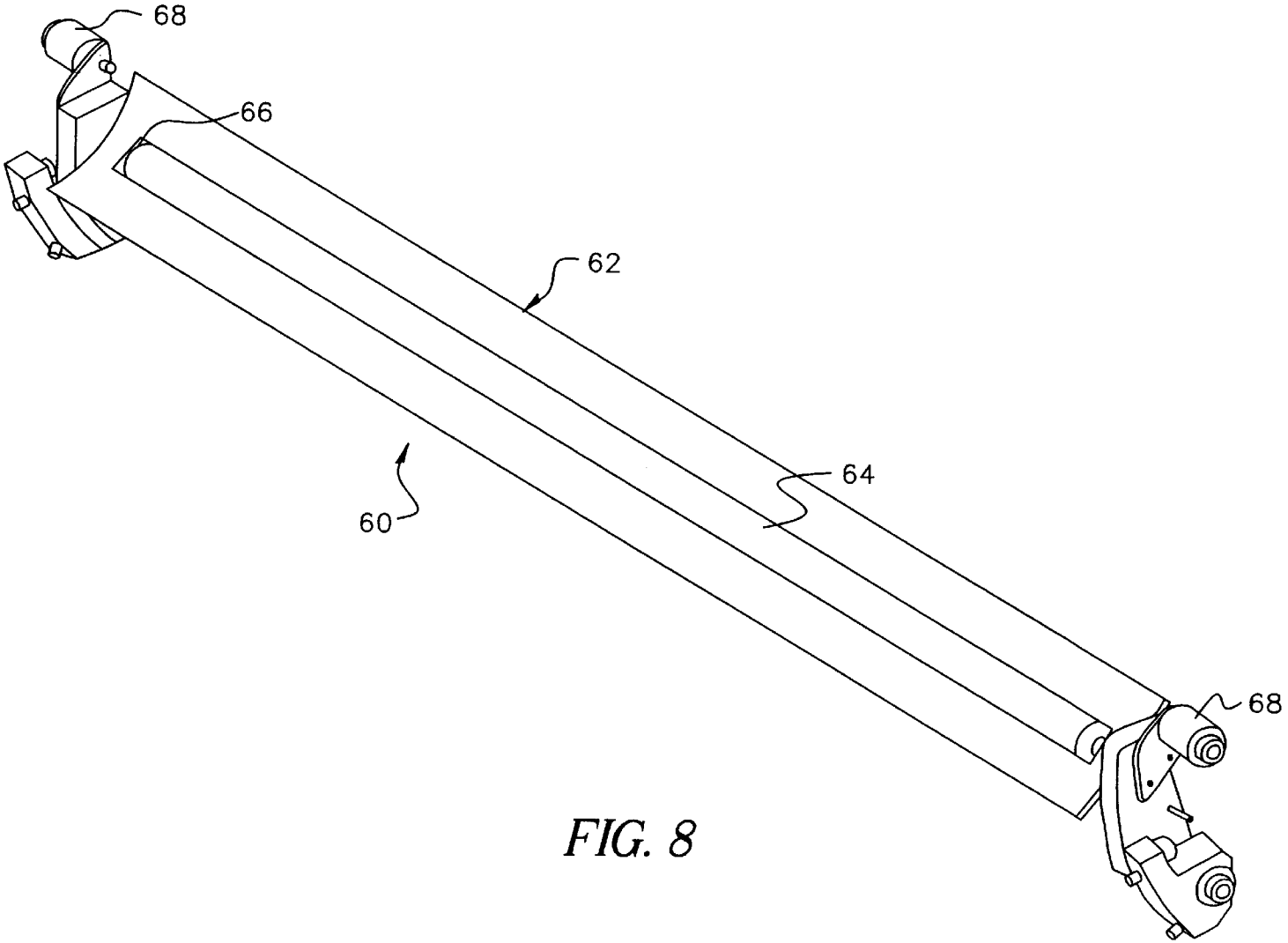
FIG. 8 is a perspective view of an element guide which can be a part of the thermal processor shown in FIGS. 1–3.
Figure 9:
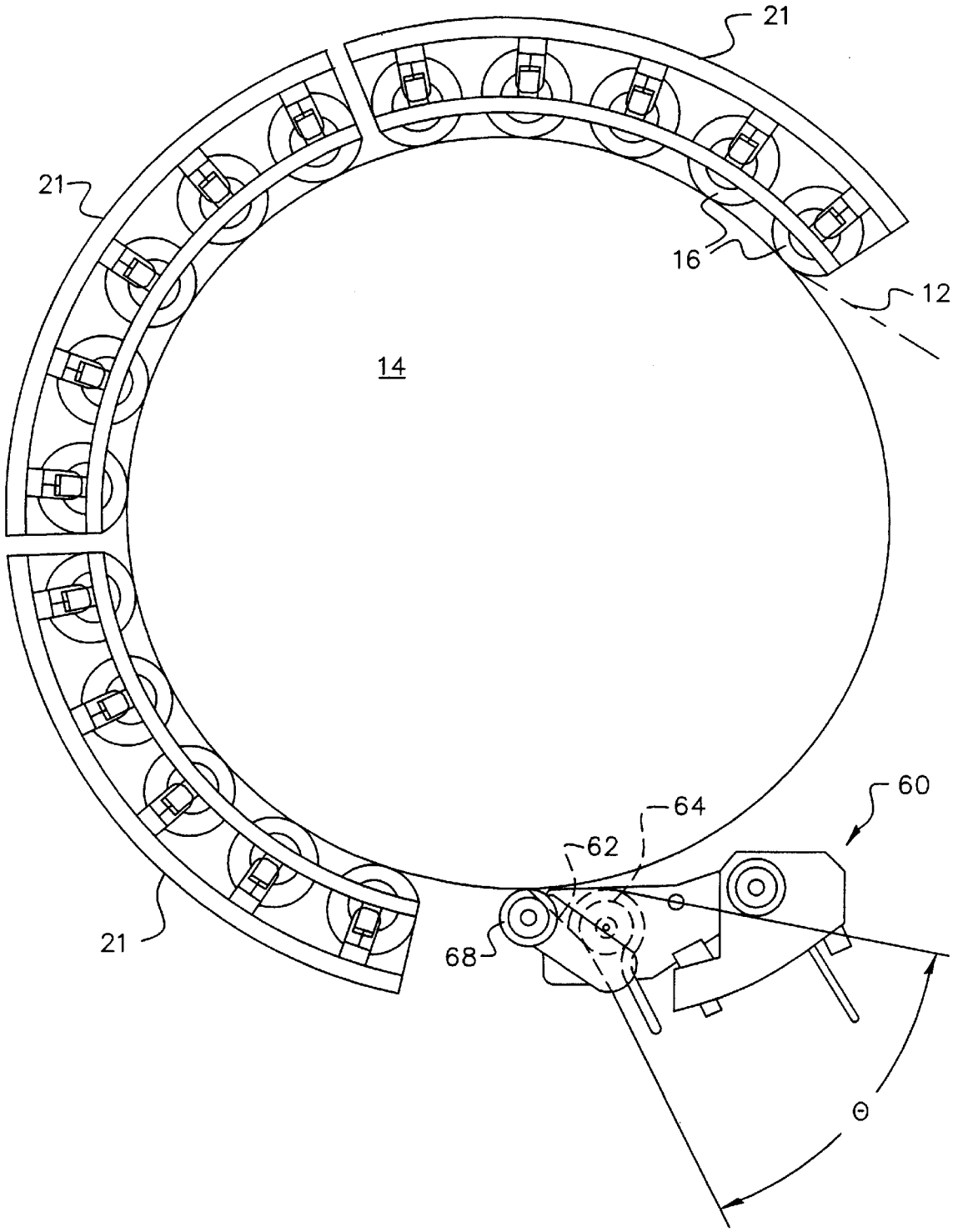
FIG. 9 is a side view of the element guide, shown in FIG. 8, against a heated member.

Element guide 60, shown in FIGS. 8 and 9, addresses both needs. Element guide 60 includes guide plate 62 and guide roller 64 which rests within guide roller slot 66 in guide plate 62. Element guide 60 can be biased near heated member 14. As shown, element guide 60 also includes guide bearings 68 which roll on heated member 14 and position guide plate 62 at a fixed distance from heated member 14. This prevents guide plate 62 from contacting heated member 14 and potentially damaging the surface of heated member 14. In addition, element guide 60 can be sufficiently rigid so that a user can wipe away foreign matter from element guide 60 without it flexing to a point where it contacts heated member 14.

Element guide 60 can guide the leading edge and a main portion of photothermographic element 12. Guide plate 62 receives the leading edge of photothermographic element 12 when photothermographic element 12 is on said surface of heated member 14. In one embodiment, the fixed distance between guide plate 62 and heated member 14 is approximately 0.005 inch (0.127 millimeters) so that the leading edge of an 0.008 inch (0.203 millimeters) thick photothermographic element 12 in intimate contact with heated member 14 can strike guide plate 62 and buckle over guide plate 62 toward guide roller 64. Guide roller 64 can receive the leading edge from guide plate 62. Due to its position, guide roller 64 can rotate and move photothermographic element 12 away from the surface of guide plate 62 so that the remaining or main portion of photothermographic element 12 does not come in contact with guide plate 62. This prevents marring of the remaining or main portion of photothermographic element 12 by the fixed nature of guide plate 62. Guide roller 64 can be made of Willtec foam material available from Illbruck Inc., Minneapolis, Minn.

The angle θ, shown in FIG. 9, at which element guide 60 guides photothermographic element 12 away from heated member 14 is important to minimize the curl created due to the heating and cooling of photothermographic element 12. The flatness of photothermographic element 12 after being developed can depend on the angle at which the heated photothermographic element 12 is removed from heated member 14 and the temperature gradient within the photothermographic element 12 during the cooling process. In order to develop photothermographic element 12 with a dynamic curl (ANSI standard test PH1.29-1985) of preferably not more than 0.4 inch (10.0 millimeters) and more preferably not more than 0.2 inch (5.0 millimeters), photothermographic element 12 should not be subjected to abrupt changes in temperature as photothermographic element 12 is transported off heated member 14. In an ideal situation photothermographic element 12 is allowed to slowly equilibrate over an extended transport distance. It has been found that, for photothermographic element 12 having a thickness of 0.008 inch (0.20 millimeters), the angle q should preferably be at least 10 degrees and more preferably between 10 and 50 degrees to achieve an acceptable flatness. For photothermographic element 12 having a different type and caliper of base material or emulsion/imaging layer, this angle q may vary.

Figure 10:
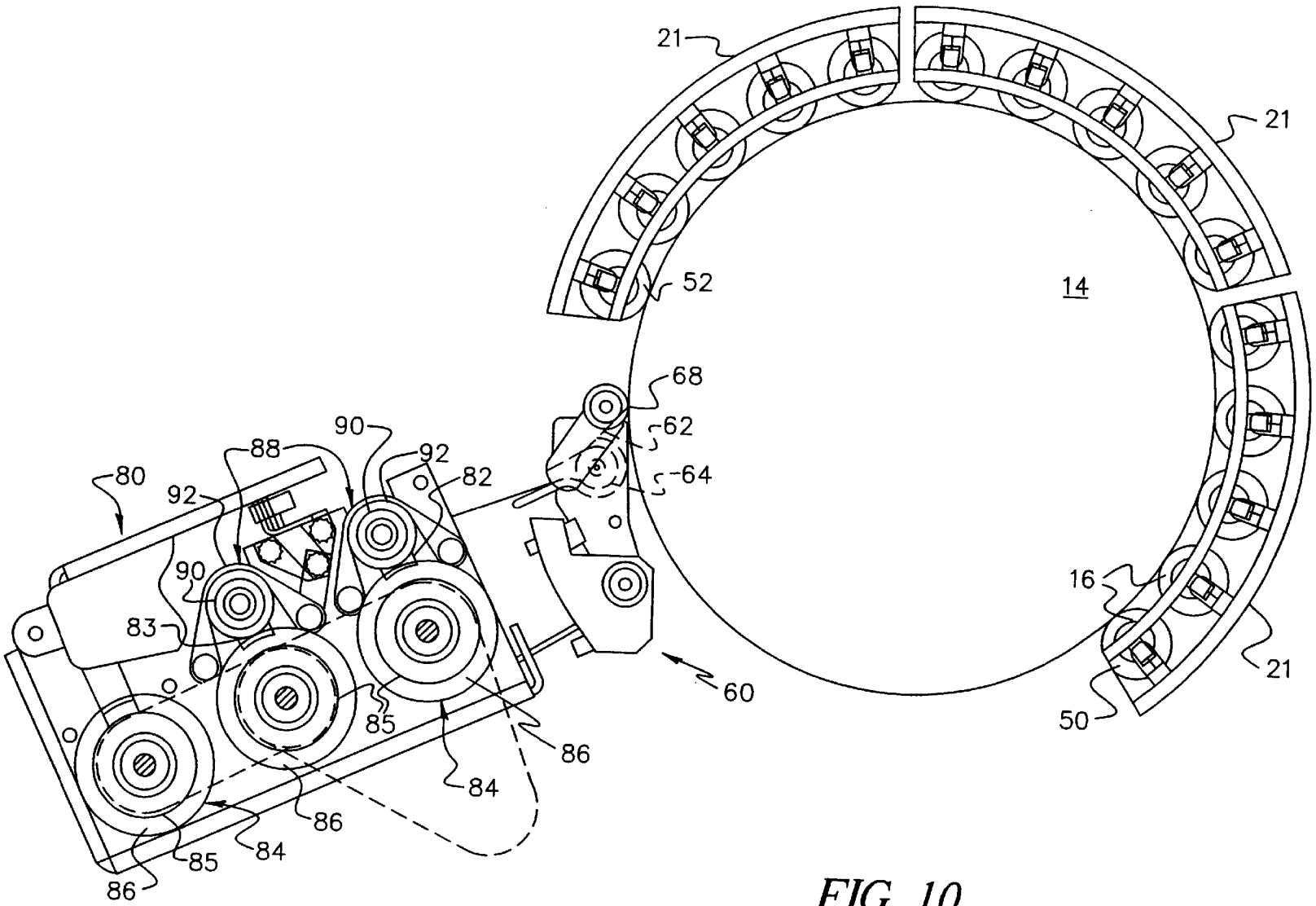
FIG. 10 is a perspective view of a cooling apparatus which can be a part of the thermal processor shown in FIGS. 1–3.

Element guide 60, as mentioned, can guide photothermographic element 12 to cooling apparatus 80, such as that shown in FIG. 10. To allow for a minimum apparatus footprint and maximum apparatus throughput, it is preferred that photothermographic element 12 be cooled within a short distance and within a short time. However, the rate of cooling is controlled so that significant temperature gradients are not introduced within photothermographic element 12 which could cause undue stress resulting in non-uniform changes in dimension or wrinkling. The cooling rate is controlled such that photothermographic element 12 does not experience abrupt temperature changes until the temperature of photothermographic element is below the glass transition temperature of the film base.

The cooling rate and flatness of photothermographic element 12 can be controlled by transporting photothermographic element 12 into cooling apparatus 80 shown in FIG. 10. Cooling apparatus 80 includes a set of rollers 84, 88 which cool and maintain the flatness of photothermographic element 12. One possible configuration includes first nip 82 which can receive and begin to conductively cool photothermographic element 12 coming from, for example, previously mentioned element guide 60. First nip 82 can forward photothermographic element 12 to a second nip 83 which conductively cools photothermographic element 12 further. Because rollers 84, 88 rotate at approximately the same rate as the transport rate of photothermographic element 12 (like guiding members 16 and heated member 14), marring of the surface of photothermographic element 12 is reduced.

The first and second nips 82, 83 can each include a heat sink roller 84 over which photothermographic element 12 passes. Heat sink rollers 84 have heat sink roller core 85 and lower conductivity external layer 86. The first and second nips 82, 83 can also include nip roller 88, having nip roller core 90 and nip roller outer layer 92. Nip roller outer layer 92 can be a material such as Willtec foam available from Illbruck Inc., Minneapolis, Minn.

Second nip 84 can forward photothermographic element 12 to another heat sink roller 84 over which photothermographic element 12 also passes. This heat sink roller 84 can be used to complete the cooling, although additional nips could be used if needed.

In one embodiment, lower thermal conductivity layer 86 is a 0.060 inch (0.15 centimeter) urethane coating onto heat sink roller core 85 made of solid aluminum and having a length of 15 inches (38.1 centimeters) and a diameter of approximately 1.3 inches (3.3 centimeters). In this embodiment, the urethane transfers the heat more slowly and serves as a buffer between the heated photothermographic element 12 and the aluminum core which has a higher thermal conductivity and thermal mass. Other combinations of thicknesses and materials can be used to provide the same cooling effect and for a particular throughput rate.

In one embodiment, a third heat sink roller 84 is also preferably a urethane-coated aluminum roller, although if uncoated, the aluminum would increase the final cooling effort.

This stepped or gradual cooling using this embodiment of cooling apparatus 80 allows for a cooling throughput of greater than 120 14 inches×17 inches (35.6 centimeters× 43.2 centimeters) photothermographic elements 12 per hour. Equally important, this cooling apparatus 80 can cool these photothermographic elements 12 within a length of 8 inches (20.3 centimeters) from heated member 14 allowing for minimal use of floor space or table space (footprint).

Imaging Device

As previously mentioned, thermal processor 10 can be used in combination with other apparatus used with photothermographic elements 12. For example, thermal processor 10 may be a module to be connected in sequence with an imaging device or an integral part of that device. The imaging device could be one that provides imagewise exposure of the paper or film by transmission of actinic radiation (e.g., light) through a negative transparency, projection of digitized laser emissions, electrostatic charge imaging or any other source of imaging energy that would form a latent image which is subsequently to be thermally developed. Both the imaging device and thermal processor 10 may also be part of a further system wherein electronic information may be initially provided from a camera, video cathode tube, line data transmission or any other source which can then be converted to an imagewise exposure on photothermographic element 12 in the imaging device.

Semiconductor laser diodes are used extensively in photographic imaging devices in both the Medical and Graphic Arts market, in medical imagers and imagesetters, respectively. Current Graphic Arts imagesetters utilize infrared laser diodes of typically 5–30 milliwatt power, while the present 3M medical laser imager typically uses a 15 or 30 milliwatt Infrared laser diode for silver halide applications. The use of semiconductor laser diodes follows from the well-established application of conventional lasers (argon ion, helium-neon, etc.) in silver halide imaging devices. The increasing popularity of solid state semiconductor laser diodes derives from their greater convenience, reduced size, higher cost-effectiveness, longer service life, ability to be easily modulated, and continuous tone capability.

Narrow beams of radiation are used to provide spot exposures on photothermographic elements 12 to generate latent images which are thermally developed in thermal processor 10. These narrow beams expose spots on the photothermographic elements 12 (e.g., less than 600 micrometers Full Width Half Maximum (FWHM) spots, preferably less than 500 micrometers FWHM, more preferably less than 250 micrometers FWHM, and most preferably less than 150 micrometers FWHM in medical diagnostic imaging and less than 150 micrometers FWHM, more preferably less than 100 micrometers FWHM, and most preferably less than 50 micrometers FWHM in graphic arts imaging). When the area of these spots overlaps the area of other spots, increases in film speed, contrast, and image quality of the image are produced on photothermographic element 12. The process for multiple raster scanning by narrow beams or coherent radiation is described in U.S. Pat. No. 5,780,207.

The light emitted by a coherent radiation source such as a laser or a laser diode appears to be monochromatic, of fairly uniform beam width, and of somewhat consistent spot shape (from a given radiation source). However, in the reality of imaging, there are imperfections in the spot of light. The coherent light sources are effectively turned on and off for each spot or pulse to be generated.

Additionally, the light spot is not usually moved from point to point, with the radiation source "off" when the direction of the imaging source is moved. The source may move steadily and the radiation turned on and off as the spot is moved along the focal plane. This can give the spot an appearance other than the emitted shape from the source, and the energy distribution within the spot is not idealized (that is, it is more Gaussian than uniform throughout the area of the spot). The advantages of using a monochromatic radiation source are well known in the art.

The movement of the scan, in combination with the energy gradient driving the imager will also cause a distribution of energy within a spot. Perpendicular to the direction of the fast scan (at the top and bottom of a horizontally moving spot) and along the direction of movement there will be a lower energy at the trailing edge of a spot (the first edge of a spot generated by a pulse) and the leading edge of a spot (the last edge of a spot generated during a pulse) as compared to the physical or statistical center of a spot. In addition to the limitations of speed and other sensitometry imposed upon image quality by photothermographic elements 12, these variations in radiation sources do not naturally combine to form a high quality imaging system with coherent radiation exposed photothermographic elements 12.

The normal exposure time or dwell time of a pixel (which may comprise a number of spots within an ordered pattern or array) is often on the order of 0.1 (e.g., 0.01 to 1) microseconds. The dwell time (pulse rate) for the pixels is usually between 0.02 and 10 microseconds for medical diagnostic imaging applications and usually less than 0.10 microseconds for graphic arts applications, the larger numbers indicating a less preferred slow imaging system where lower powered impulses may be used because of the needs of a particular imaging system. In the practice of the present invention, a pixel rate of 0.03 to 6 is preferred, 0.05 to 5 more preferred, and 0.08 to 3 most preferred to take maximum advantage of the practice of the present invention. Of course, as improvements in media, coherent light sources, spectral absorbers, hardware, software, and the like become commercially available, this range could well shift. The pixel exposure time is dependent upon the speed of the spot as it moves along the focal plane. The spot velocity is usually between 1 and 1000 meters/sec. The various characteristics of the pulse and imaging process are generally related as the higher the output of the coherent radiation source, the shorter need be the pixel exposure time and the faster may be the spot velocity.

The power output of the coherent light source generally should be able to provide an impulse of at least 600 ergs/cm$^2$ at the focal plane of the imaging device from one (usually) or more light sources (e.g., point sources such as a laser or laser diode). At the present level of technology, the radiation source should be between at least 400 ergs/cm$^2$ up to about 4000 ergs/cm$^2$. A preferred range for energy output would be between about 600 to 3000 ergs/cm$^2$ per impulse at the focal plane of the imaging device. The power output of the laser diode as a function of the current through the laser diode should ideally be linear and have a dynamic range ($P_{Max}$to $P_{Min}$) of greater than 50 to 1, more preferably greater than 100 to 1 and most preferably greater than 200 to 1. The spots are generated from the diode by providing a current (e.g., multiple continuous or single pulses) to the diode which corresponds to the data, coming at 1 to 20 Megahertz, to reproduce 8–12 bit (256 to 4096) gray levels for continuous tone printing. Additionally, the laser diode is superimposed with a high frequency oscillation to cause laser line width broadening greater than 1 nanometer, preferably greater than 2 nanometers, and more preferably between 2–6 nanometers. The line broadening reduces the interference artifacts observed on the photothermographic element 12. In order to cause line broadening, the oscillation amplitudes are driven below the knee of the power versus current characteristics of the laser diode. The maximum amplitude of the oscillation current should be at least twice the average power required to produce an optical density on the photothermographic element 12 greater than 2.5. At this optical density level, the interference related image artifacts are not visible to the human eye. The oscillation frequency of the laser diode should be significantly higher than the data rate to sustain significant line broadening and reduce image artifacts. Typical oscillation frequencies are in the range of 300 to 800 Megahertz.

For medical diagnostic imaging applications, the system performance of the photothermographic elements 12, imaging device and thermal processor 10 is balanced in such a way to achieve an optimum image quality, which includes producing images with at least 64, more preferably at least 128, and most preferably at least 256 gray levels, a minimum density of less than 0.25 optical density units, a maximum density of greater than 2.6 optical density units, resolution of more than 3 line pairs per millimeter, and an image uniformity of less than or equal to 0.15 change in optical density within a 14 inches×17 inches (35.5 centimeters×43.1 centimeters) image area at a specific optical density within a range of 0.50 and 3.0 optical density. In addition, the unexposed and final imaged photothermographic elements 12 have a dynamic curl (ANSI standard test PH1.29-1985) of less than 20millimeters, preferably less than 0.4 inch (10 millimeters), and more preferably less than 0.2 inch (5 millimeters), and no visible scratches or wrinkles.

Optical density uniformity is controlled by the performance characteristics of photothermographic element 12 in combination with the exposure variations of the imaging device and the temperature control of thermal processor 10. The optical density uniformity of photothermographic element 12 can be influenced by the coating formulation as well as the coating process. The rheology of the coating formulation is optimized to achieve uniform thickness of the coating across the sheet or web. The turbidity or haze of the coating is minimized to reduce light scattering within the coated layers. The sensitometric response of the photothermographic emulsion is optimized to perform within the limitations of the exposure latitude of the imaging device and processing latitude of thermal processor 10. The thermal processing latitude of photothermographic element 12 is determined by comparison of the optical density versus the log of the exposure time at a range of development temperatures. The photothermographic emulsion formulation and thermal processor 10 conditions are chosen for the best match of thermal processing latitude of photothermographic element 12 versus the temperature control of thermal processor 10. The temperature of thermal processor 10 is controlled to a temperature variation of less than or equal to 5° F. (2.78° C.), preferably less than or equal to 3° F. (1.7° C.), more preferably less than or equal to 2° F. (1.1° C.) and most preferably less than or equal to 10° F. (0.55° C.). The temperature of thermal processor 10 is controlled by a temperature controller such that the thermal equilibrium conditions are re-established in a very short time to minimize sheet to sheet and within a sheet of photothermographic element 12 optical density variations, especially at high throughput rates. An example of a temperature controller is described in U.S. Pat. No. 5,580,478.

Exposure (number of photons of a predetermined energy per unit area per unit time) variations in the imaging device may also influence optical density uniformity. A 2% exposure variation can result in a 0.01 to 0.02 change in optical density. The exposure variation is minimized by controlling the consistency of the laser diode emission, the use of high frequency modulation of the laser, monitoring the beam power, and the use of look up tables. The optical density non-uniformity, caused by various sources such as galvanometer scanners 122, 124 in a 2D laser scanner 112, or by polarization-induced reflectance changes, is measured across the fast scan direction x. Corresponding exposure corrections for optical density non-uniformities are stored in an erasable programmable read-only memory within the electronics of the laser scanner 112. These corrections are used as dynamic multipliers to the actual spatial laser exposure values. The imaging device is controlled to an exposure variation of less than or equal to 6%, preferably less than or equal to 4%, and most preferably less than or equal to 2%.

Photothermographic element 12 is formulated and coated to achieve a change in optical density of less than or equal to 0.1. Knowing the limitations introduced by each of the components of the system, the system can be balanced to achieve an optical density uniformity of less than or equal to 0.30 optical density units, more preferably less than or equal to 0.20 optical density units, and most preferably less than or equal to 0.15 optical density units at a specific optical density.

Figure 11:
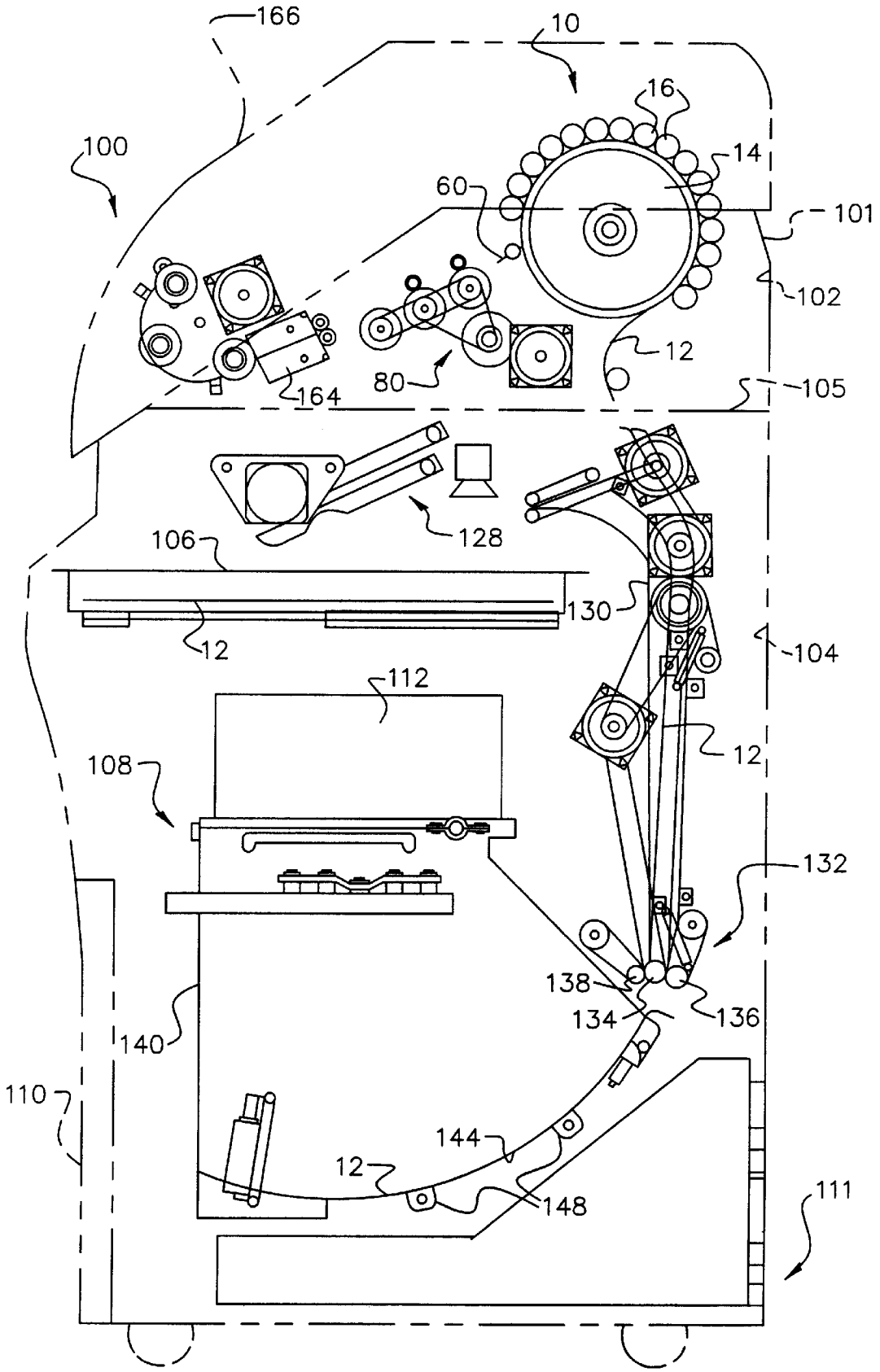
FIG. 11 is a side view of the internal operational portions of an apparatus which includes a thermal processor and a optical scanning module.

An embodiment of the present invention illustrated in FIG. 11 describes an apparatus 100 which can be used in conjunction with photothermographic element 12 to meet the system performance targets for medical diagnostic imaging applications. As shown, apparatus 100 includes cartridge 106 containing at least one photothermographic element 12, an optical scanning module 108, electronics module 110, and integrated thermal processor 10 enclosed in enclosure 101.

Cartridge 106 contains unexposed photothermographic elements 12. An optical bar code (not shown) with a unique cartridge 106 identification, photothermographic element 12 size, photothermographic element 12 type information, and photothermographic element 12 sensitometric information is attached to the bottom surface of cartridge 106. Information is read from the bar code as cartridge 106 is opened. The image management subsystem (not shown), which is part of electronics module 110, controls laser scanner 112 as a function of the input data and the sensitometric information read from the bar code. The image management subsystem also causes thermal processor 10 to develop photothermographic element 12. The image management subsystem may also set the thermal processor 10 conditions to develop photothermographic element 12 as a function of photothermographic element 12 type information read from the bar code. The system for scanning the bar code and controlling the information is described in U.S. Pat. No. 5,229,585.

Photothermographic element 12 is transported out of cartridge 106 by suction feed mechanism 128. Photothermographic element 12 is then fed into staging area 130 where photothermographic element 12 is transported by bi-directional film staging mechanism 132 (described later) into optical scanning module 108. Staging area 130 allows the positioning of photothermographic element 12 near optical scanning module 108 so that photothermographic element 12 is ready to be fed into optical scanning module 108 without operating suction feed mechanism 128 during the scanning of a previously fed photothermographic element 12. This helps to eliminate the vibrations which may cause artifacts in the final image. It also increases productivity in the imaging process by staging photothermographic element 12 in a queue position ready for entry into optical scanning module 108.

Figure 13:
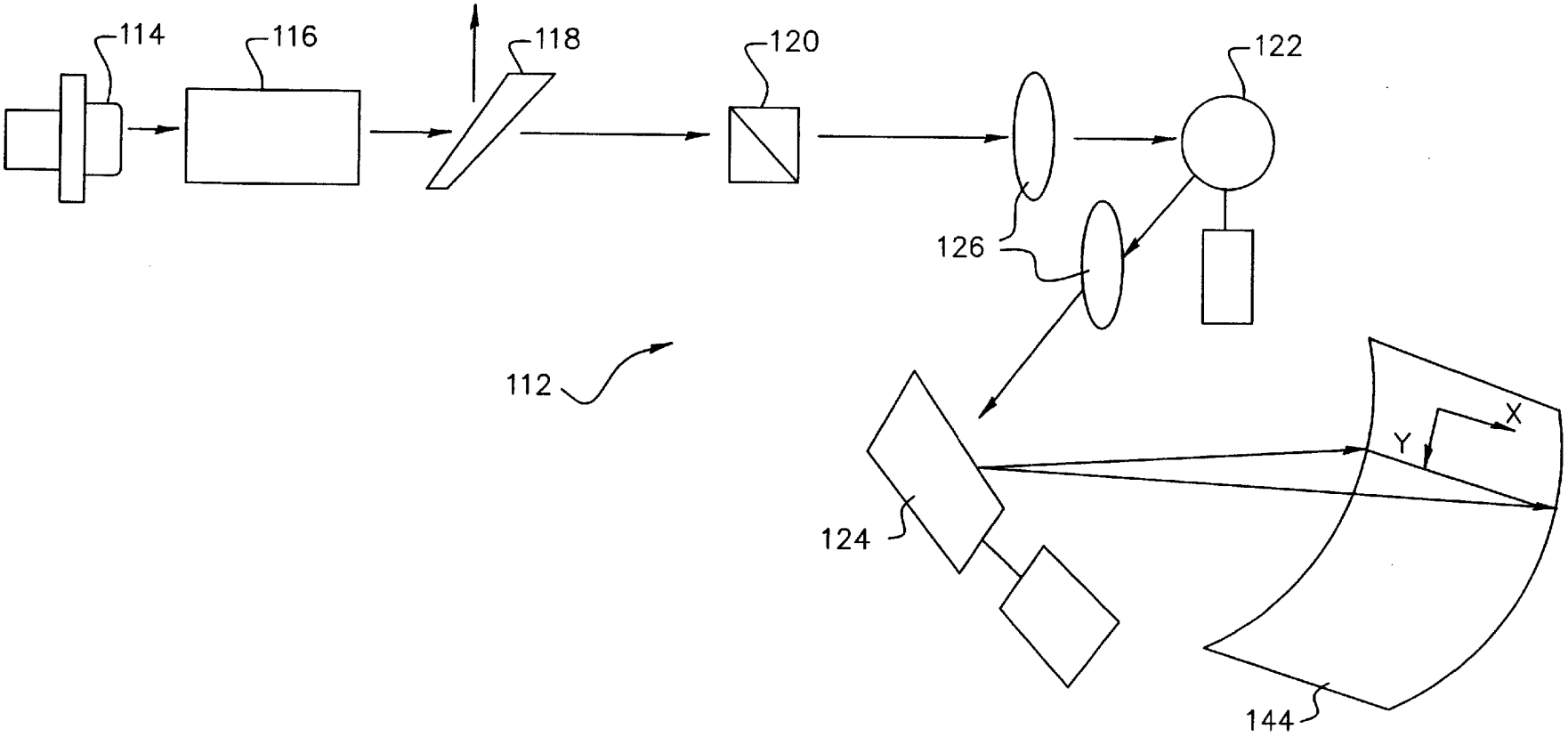
FIG. 13 is a schematic view of a laser scanner which is a part of the optical scanning module shown in FIG. 12.

Optical scanning module 108 includes laser scanner 112 shown in FIG. 13. Laser scanner 112 includes laser diode 114 with collimating and polarizing optics 116, beam splitter 118 which splits 2–10% of the main beam for feedback to laser diode 114 for linearizing laser scanner 112, attenuator 120 to control the maximum power at the surface of film platen 144, resonant galvanometer scanner 122 to scan the beam in the fast scan direction x and linear galvanometer scanner 124 to scan the beam in the slow scan direction y on photothermographic element 12 which is statically disposed on film platen 144. A set of lenses 126 between the attenuator 120 and galvanometer scanners 122,124 are used to focus the beam on film platen 144 with flat field correction across the slow scan direction y. Representative 2-D Infrared laser scanners 112 are described in U.S. Pat. Nos. 4,750,045, 5,237,444, and 5,121,138.

Laser scanner 112 uses multiple exposures and preferably multiple scanning to improve image quality. Multiple scanning is implemented by scanning several smaller overlapping spots to create a single pixel line. This improves sensitometric performance of most photothermographic elements 12 and improves image sharpness. Additionally, modulation transfer function of photothermographic elements 12 with minimal reciprocity problems is improved by this technique because of a reduction in scan line artifacts. Optical scanning module 108 typically uses triple scanning for creating a single pixel line. For a 78 micrometer pixel line, the spot size is approximately 45 micrometers×60 micrometers, the larger dimension being the spot size in the slow scan direction y. Suitable scaling can be easily accomplished for different pixel sizes. Overlapping three, four, five, six, etc., spots to create the same pixel size is also possible.

Figure 12:
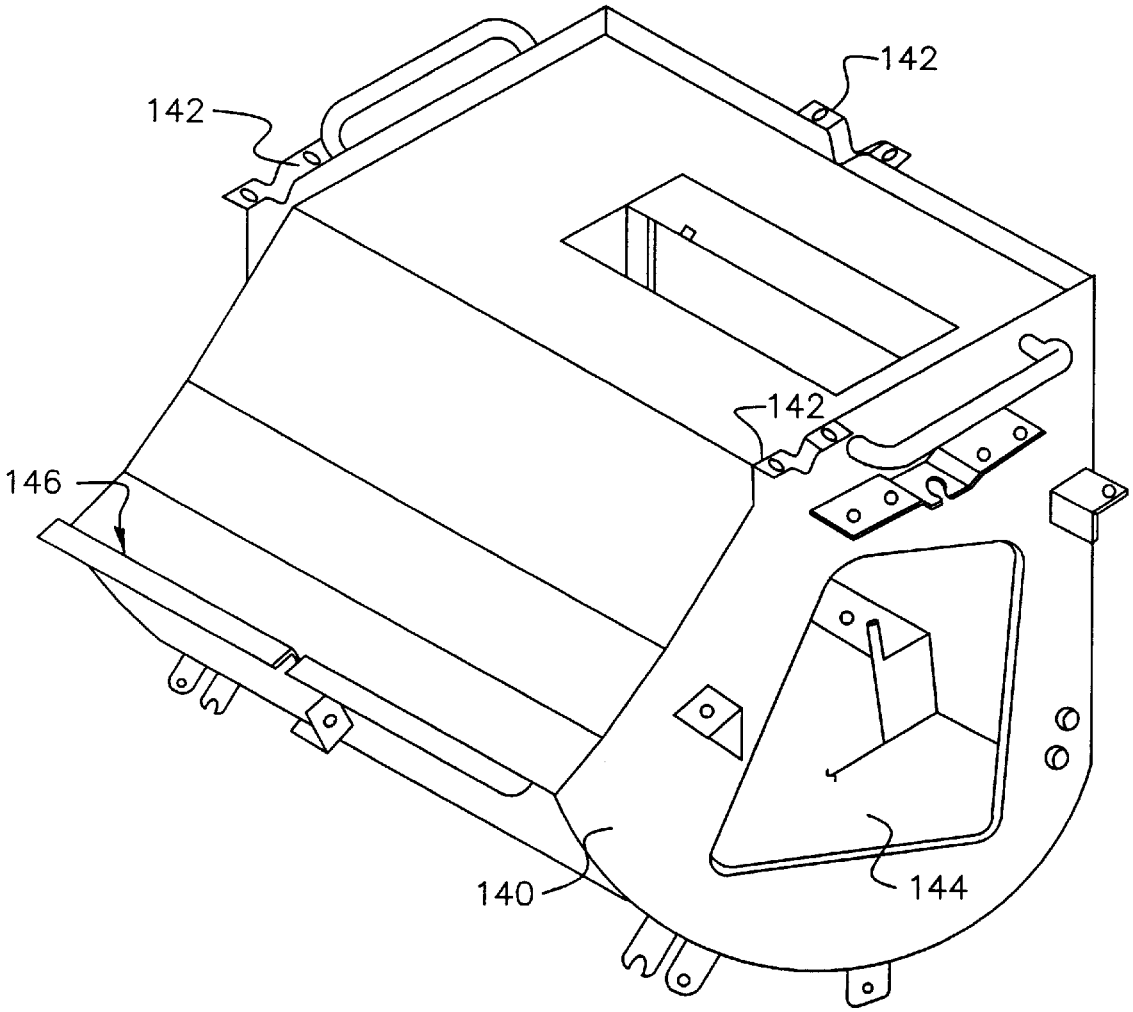
FIG. 12 is a view of an optical scanning module which is shown as a part of the apparatus shown in FIG. 11.

Laser scanner 112 is mounted onto optical frame 140, shown in FIG. 12, for aligning and holding photothermographic element 12 during the image scanning process. Optical frame 140 is constructed from a rolled sheet metal which is welded to a box-shaped housing. The use of welds in place of joints helps to eliminate a potential source for vibration. 2-D Infrared laser scanner 112 is mounted at three V-clamp points 142. Photothermographic element 12 can be transported onto cylindrical film platen 144 through film feed slot 146 where photothermographic element 12 is scanned by the laser. The surface of film platen 144 is coated with a light absorbing material to reduce the reflection of the laser beam which causes undesirable halation effects in the image. When an infrared laser is used as the radiation source, infrared sensitized photothermographic elements 12 are particularly sensitive to halation at wavelengths of 800–820 nanometers due to the high spectral transmittance at wavelengths of 800–820 nanometers of photothermographic element 12. The light absorbing material preferably has a low reflectivity at the wavelength spectrum of radiation source. In addition, the light absorbing material is preferably abrasion resistant and has a low coefficient of friction. The static and kinetic coefficient of friction between the photothermographic element 12 and the light absorbing surface of film platen 144 is preferred to be less than 0.2. An example of a preferred light absorbing material, which has a very low reflectivity (less than 5% spectral reflectance) below 900 nanometers, is Impreglon 218C available from E.I. DuPont De Nemours & Co., Wilmington, Del.

Figure 14:
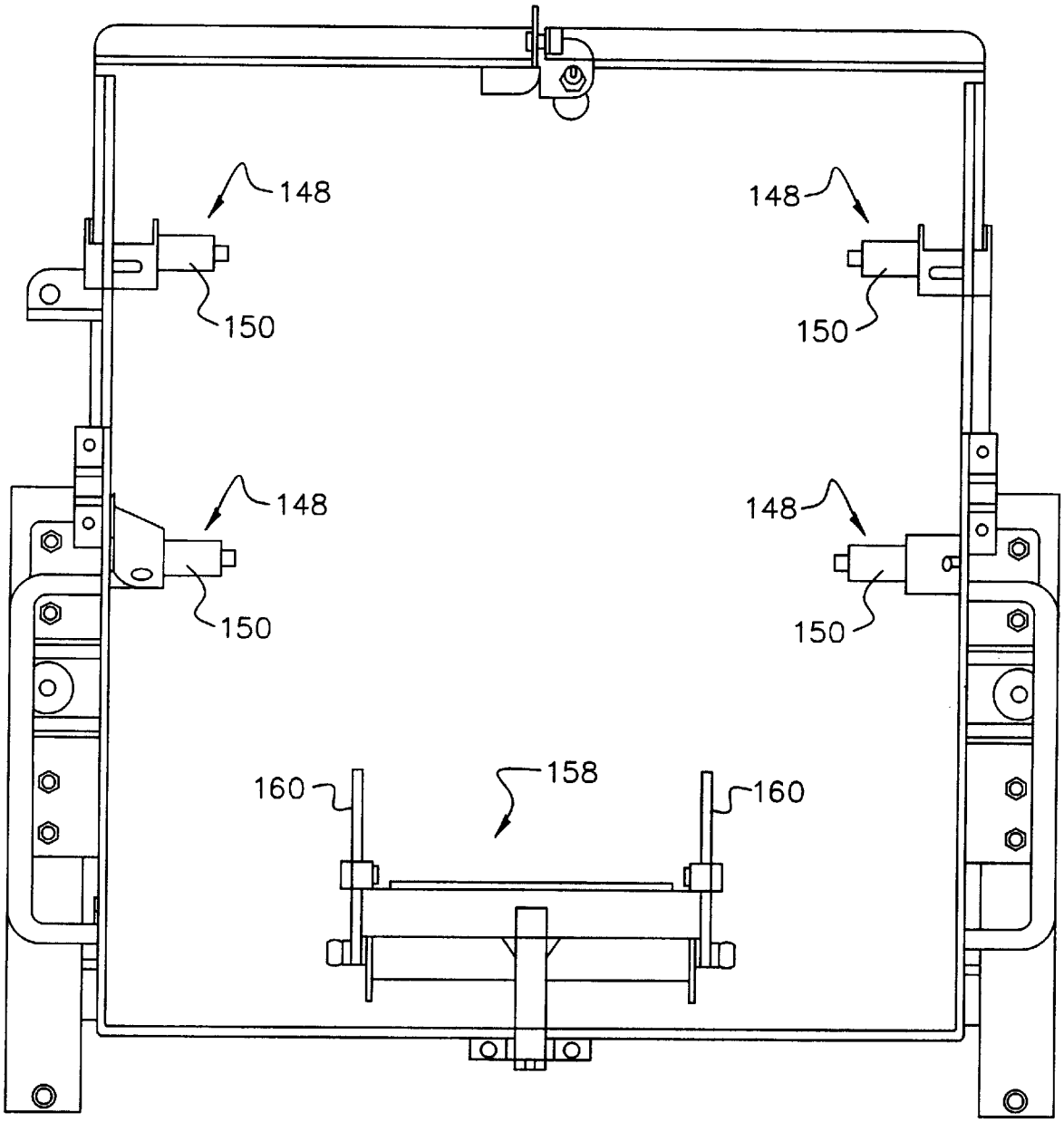
FIG. 14 is a bottom view of a portion of the optical scanning module shown in FIG. 12.
Figure 15:
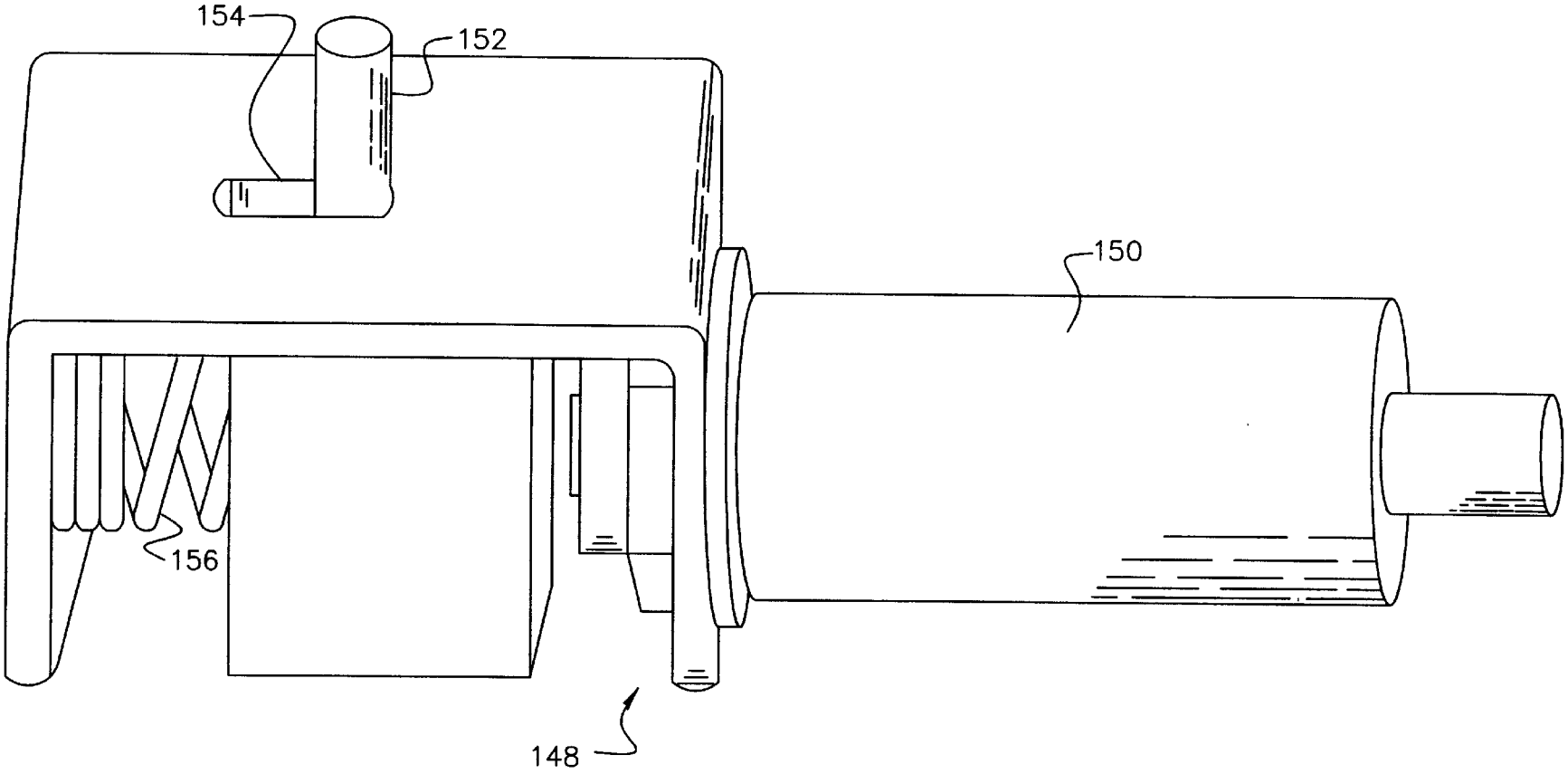
FIG. 15 is a perspective view of a film alignment device for use within the optical scanning module shown in FIG. 12.

Film alignment devices 148, shown in FIGS. 14 and 15, includes push solenoid 150 connected to pin 152 may be used to assist in proper alignment of photothermographic element 12 on film platen 144. Film alignment devices 148 are mounted on the underside of film platen 144 allowing pins 152 to protrude through slots 154. A set of four film alignment devices 148 are used to perform the alignment and centering of photothermographic element 12. As photothermographic element 12 is transported onto film platen 144, solenoids 150 are engaged allowing pins 152 to be compressed against springs 156 resulting in the movement of pins 152 away from the center of film platen 144 and thus clearing the path for the transport of photothermographic element 12 onto film platen 144. After photothermographic element 12 is transported upon the surface of film platen 144, solenoids 150 are disengaged allowing pins 152 to move toward the edges of photothermographic element 12 by action of springs 156. Photothermographic element 12 is then centered due to the balance of the spring forces.

Optical frame 140 is lighter and more compact than conventional machined fixtures used in most laser imaging systems. By integrating 2-D laser scanner 112 with film platen 144, optical scanning module 108 can be vibrationally isolated from the rest of apparatus 100 and kept compact in size. Another advantage of having laser scanner 112 integrated with film platen 144 is that any vibration within optical scanning module 108 will be in phase, thus reducing image artifacts. This vibrational isolation allows parallel operations within apparatus 100 without effecting the final image quality of the imaged photothermographic element 12.

Once the scanning of the image is complete, then exposed photothermographic element 12 is transported out of film platen 144 by use of film ejection mechanism 158 comprising spring-biased, hinged lever arm pair 160 which is coupled to solenoid plunger 162 through a hook and bar connection. The spring-biasing holds level arm pair 160 retracted from the edge of exposed photothermographic element 12 until ready for transportation of exposed photothermographic element 12 out of film platen 144. When solenoid 162 is actuated, it pivots lever arm pair 160 against the edge of exposed photothermographic element 12 and moves exposed photothermographic element 12 out of the plane of film platen 144 toward bidirectional film staging mechanism 132 for transportation of exposed photothermographic element 12 to thermal processor 10. Film ejection mechanism 158 works particularly well with photothermographic elements 12 having a thickness greater than 5 mils (0.18 millimeters). Bi-directional film staging mechanism 132, shown in FIG. 11, comprises a set of three rollers 138, 134, and 136 where center roller 134 is driven and rollers 138, 136 are idlers. Film staging mechanism 132 is designed such that exposed photothermographic element 12 can be transported out of film platen 144 between rollers 134 and 136 while simultaneously transporting unexposed photothermographic element 12 onto film platen 144 between rollers 134 and 138, if desired, chosen such that marring and static electricity introduced on the surfaces of photothermographic element 12 while being transported through the film staging mechanism 132 are kept to a minimum.

Electronics module 110 includes three interactive control systems; the image management control system, the laser optics control system, and the machine control system. The operator can interface with the electronics through either a keypad mounted on the console, a portable keypad, or a modem.

The laser optics control system includes a closed loop circuit which controls the intensity of laser diode 114 in laser scanner 112 which is described in U.S. Pat. No. 5,123,024. The laser optics control system also receives information through the machine control system from densitometer 164 mounted at the output of thermal processor 10. Densitometer 164 reads and compares optical density information from an optical density patch generated during the scanning process having a predetermined target optical density on the trailing edge of developed photothermographic element 12. If necessary, the laser output is adjusted to compensate for any minor differences in optical density. If the differences are too large, then the machine automatically recalibrates itself.

Processor conditions are controllable by the machine control electronics which receive information read from the bar code on the film cartridge and may be controllable by other systems interfaced with the system controller within the machine control system, e.g., densitometer 164.

Enclosure 101 of apparatus 100 is divided into two primary chambers, upper chamber 102 and lower chamber 104, with a passage for transporting photothermographic element 12 between the two chambers. Thermal processor 10 is preferably located in upper chamber 102. Lower chamber 104 containing optical scanning module 108, electronics module 110, and power supply 111 is kept at a positive pressure with respect to upper chamber 102 to prevent damage of the optics due to volatile materials outgassed from photothermographic elements 12 during the thermal processing of photothermographic elements 12 and to protect optical scanning module 108 from detrimental temperature increases. Lower chamber 104 is equipped with an air intake and upper chamber 102 is equipped with an exhaust to facilitate air flow from lower chamber 104 to upper chamber 102. Lower chamber 104 may be additionally divided into sub-chambers to isolate the optical scanning module 108 from electronics module 110 to further protect optical scanning module 108 from detrimental temperature increases. Apparatus 100 may be equipped with an internal or external filtering system to reduce odors generated during the thermal processing of photothermographic element 12 from outgassing of volatile materials within photothermographic element 12. In addition to the positive pressure in lower chamber 104, the filtering system assists in reducing the deposition of materials on components within apparatus 100. Although convenient for the preferred embodiment of apparatus 100 illustrated in FIG. 11, the chambers could be positioned in alternative orientations such as side by side.

Enclosure 101 can include an openable cover 166. For example, openable cover 166 can be pivotally connected to the remainder of enclosure 101. Guiding members 16 can be attached to cover 166 so that when cover 166 is opened, guiding members 16 are lifted away from heated member 14 providing easier access to heated member 14. This access allows for easier cleaning of heated member 14 and guiding members 16 and assists in clearing any jams that may occur during the transportation of photothermographic element 12 through thermal processor 10.

Guiding members 16 can, instead, be independently moveable from heated member 14 and cover 166. With this ability, guiding members 16 can move from a closed position against heated member 14 to an open position for cleaning heated member 14.

The integration of optical scanning module 108 and thermal processor 10 into a single unit provides several advantages. The footprint of apparatus 100 can be minimized to a size less than 80 centimeters×90 centimeters. The image quality and performance characteristics of the final imaged photothermographic element 12 can be controlled and adjusted automatically. The automated control also maximizes productivity of the imaging process. Photothermographic element 12 can be imaged while thermally processing a second photothermographic element 12 to increase productivity. A typical throughput of imaged photothermographic elements 12 is 120 14 inches×17 inches (35.5 centimeters×43.1 centimeters) sheets per hour when photothermographic elements 12 are used. The throughput rate may vary depending on the sensitometric characteristics and size of photothermographic element 12.

For graphics arts imaging applications, the system performance of photothermographic elements 12, the imaging device, and thermal processor 10 must also be balanced in such a way to achieve an optimum image quality. Unlike medical diagnostic imaging films, graphic arts films depend on halftone dots to simulate tonal curves instead of continuous tone imaging. The image quality targets are therefore slightly different for the graphic arts applications. The image uniformity is preferably less than or equal to 0.15 change in optical density within a 12 inches×18 inches (30.5 centimeters×45.7 centimeters) image area at a specific optical density (typically at maximum optical density). The resolution is preferably 1200 to 3300 dots per inch (2.54 centimeters). The Ultraviolet minimum density ($D_{Min}$) is preferably less than or equal to 0.5 optical density units and the maximum density ($D_{Max}$) is preferably greater than or equal to 2.6 optical density units and more preferably greater than or equal to 3.2 optical density units. The dot gain of a 50% halftone dot is preferably less than 15% (before correction by a look up table) for a 133 line screen ruling and 2400 dots per 2.54 centimeters at a $D_{Max}$ greater than 2.6. In addition, unexposed and final imaged photothermographic elements 12 have a dynamic curl (ANSI standard test PH1.29-1985) of less than 0.8 inch (20 millimeters) and preferably less than 0.4 inch (10 millimeters) and more preferably less than 0.2 inch (5 millimeters), and no visible scratches or wrinkles.

An imagesetter is typically used as the imaging device for imaging photothermographic elements 12 in graphic arts applications. An example of an imagesetter which uses a laser diode for the radiation source is Ultre*Setter, available from Ultre*Corporation, Port Washington, N.Y. The Ultre*Setter apparatus is described in the reference (W. Hansen, "A low cost, High quality laser recorder for personal typesetting", *Hard Copy Output*, Leo Beiser, Editor, Proc. SPIE Vol. 1079, pp. 36–42 (1989)). The image is raster scanned with a laser but instead of modulating the laser beam to give exposure of varying energy to achieve continuous tone images, an imagesetter exposes to the same energy and modulates the laser beam on or off at the energy level where maximum density is achieved. The shorter time the beam is on, the smaller the line segment; and the longer the beam is on, the longer the line segment. By building up the line segments with a degree of overlap to avoid visible scan lines, dots of various sizes can be created to simulate gray levels when printed.

There are typically three types of imagesetters used in graphic arts applications; external drum, internal drum, and capstan. The external drum and internal drum typically use precut film sheets, whereas the capstan typically uses roll film.

An embodiment of the present invention which is capable of producing high quality images which meet the graphic arts image quality targets includes photothermographic element 12 (except a 4 mil (0.10 millimeters) base is used instead of a 7 mil (0.18 millimeters) base), an imagesetter such as the Ultre*Setter described above, and thermal processor 10 described and illustrated in FIG. 1. The imagesetter and thermal processor 10 could be separate units or integrated into a single device.

Another aspect of the present invention is a process for converting digital data to a visible image by imaging and developing a photothermographic element 12. Photothermographic element 12 is exposed to modulated radiation to create a latent image within photothermographic element 12 representative of the digital data. The latent image stored within the exposed photothermographic element 12 is rendered visible by contacting photothermographic element 12 with a heated member 14 in thermal processor 10 for sufficient dwell time at or above a threshold development temperature.

Photothermographic Elements

Preferred photothermographic elements used in the present invention are described in, e.g., U.S. patent application Ser. No. 08/946,945 filed on Oct. 9, 1997. A publicly-available photothermographic element known as Imation DryView brand imagesetting film can be used with the disclosed thermal processor and with available imagesetters (laser imaging or exposing device). The combination of the publicly-available photothermographic element and imagesetter and the inventive thermal processor provides an inventive system.

In addition to being useful with a photothermographic element, the present invention is useful with other thermally-developable imaging elements.

Although the present invention has been described with reference to preferred embodiments, those skilled in the art will recognize that variations and modifications may be made in form and detail without departing from the spirit and scope of the invention.

What is claimed is:

1. A thermal processor for thermally developing an image in a thermally developable imaging element moving at a transport rate, the thermal processor comprising:

a movable member having a heated surface;

a plurality of contact flaps biased against the heated surface of the member, the plurality of contact flaps being located immediately adjacent each other, the heated surface and the plurality of contact flaps being positioned to receive the imaging element therebetween, wherein the heated surface is movable in a transport direction at the transport rate of the imaging element such that the imaging element is heated to at least a threshold temperature for a dwell time sufficient to develop the image in the imaging element.

2. A thermal processor according to claim 1, wherein each of the plurality of contact flaps comprises a polymer sheet.

3. A thermal processor according to claim 1, wherein the plurality of contact flaps are in contact with a substantially uninterrupted portion of the imaging element during processing.

4. A thermal processor according to claim 1, wherein adjacent contact flaps of the plurality of contact flaps overlap on the heated surface of the movable member.

5. A thermal processor according to claim 1, further comprising a temperature sensor attached to at least one of the plurality of contact flaps.

6. A thermal processor according to claim 1, wherein at least one of the plurality of contact flaps includes an abrasive surface.

7. A thermal processor according to claim 1, wherein each of the plurality of contact flaps are biased against the heated surface with a biasing force of about 200 grams per centimeter or less of width of the imaging element.

8. A thermal processor according to claim 1, wherein each of the plurality of contact flaps are biased against the heated surface with a biasing force of about 100 grams per centimeter or less of width of the imaging element.

9. A thermal processor according to claim 1, wherein each of the plurality of contact flaps are biased against the heated surface with a biasing force of about 14 to about 30 grams per centimeter of width of the imaging element.

10. A thermal processor according to claim 1, wherein the plurality of contact flaps are positioned about only a portion of the heated surface of the movable member.

11. A thermal processor according to claim 10, further comprising a rotatable guide member biased against the heated surface of the movable member, the heated surface and the guide member being positioned to receive the imaging element therebetween.

12. A thermal processor according to claim 11, wherein the guide member comprises a roller.

13. A thermal processor according to claim 10, further comprising at least two rotatable guide members biased against the heated surface of the movable member, the heated surface and each of the at least two guide members being positioned to receive the imaging element therebetween.

14. A thermal processor according to claim 13, wherein at least one of the at least two guide members comprises a roller.

15. A thermal processor according to claim 1, wherein the heated surface comprises a resilient layer having a thickness and thermal conductivity for contacting the imaging element, the resilient layer being sufficiently thick so that a foreign particle can be depressed into the resilient layer to reduce an image defect in the image due to insufficient heat transfer causable by the foreign particle, and the resilient layer being sufficiently thin and sufficiently thermally conductive so that the resilient layer delivers to the imaging element sufficient heat to thermally develop the imaging element at the transport rate.

16. A thermal processor according to claim 15, wherein the resilient layer comprises an elastomeric material doped with a thermally conductive material to increase the thermal conductivity of the resilient layer.

17. An apparatus, adapted to be used with a thermally-developable, radiation-sensitive element, for converting data to an image corresponding to the data on the element, wherein the element is transported at a transport rate, and wherein the apparatus comprises:

an imaging device for converting the data to radiation, and for receiving and exposing the element on an image-wise basis to the radiation to create an image in the element; and a thermal processor, comprising:

a movable heated member positioned to receive the element after being exposed by the imaging device and to heat the element to at least a threshold development temperature to thermally develop the image in the element;

a heater thermally connected to the heated member for heating the heated member; and a plurality of contact flaps biased against the heated member, the plurality of contact flaps being located immediately adjacent each other, the heated member and the plurality of contact flaps being positioned to receive the element therebetween, wherein the heated member is movable in a transport direction at the transport rate of the element such that the element is heated to at least a threshold temperature for a dwell time sufficient to develop the image in the element.

18. An apparatus according to claim 17, wherein each of the plurality of contact flaps comprises a polymer sheet.

19. An apparatus according to claim 17, wherein the plurality of contact flaps are in contact with a substantially uninterrupted portion of the heated member.

20. An apparatus according to claim 17, wherein adjacent contact flaps of the plurality of contact flaps overlap on the heated surface of the heated member.

21. An apparatus according to claim 17, further comprising a temperature sensor attached to at least one of the plurality of contact flaps.

22. An apparatus according to claim 17, wherein at least one of the plurality of contact flaps includes an abrasive surface.

23. An apparatus according to claim 17, wherein each of the plurality of contact flaps are biased against the heated surface with a biasing force of about 200 grams per centimeter or less of width of the element.

24. An apparatus according to claim 17, wherein the imaging device comprises:

a laser scanner which exposes the element to the radiation; and a platen positioned to receive the exposed element, the platen being vibrationally coupled to the laser scanner so that the platen vibrates together with the laser scanner reducing exposure defects causable by vibration of the laser scanner.

25. An apparatus according to claim 17, further comprising a bi-directional film staging mechanism positioned between the imaging device and the thermal processor for simultaneously transporting a first element into the imaging device and a second element out of the imaging device to the thermal processor.

26. An apparatus according to claim 17, wherein the imaging device can expose a first element while the thermal processor thermally processes a second element.

27. An apparatus according to claim 17, wherein the heated member is a heated, cylindrical drum.

28. A thermal processor for thermally developing an image in a thermally developable element having a length, the thermal processor comprising:

an enclosure having a heated chamber through which the element may be transported;

transporting means for transporting the element through the heated chamber;

heating means within the heated chamber for causing thermal development of the imaging element wherein the heating means comprises at least one heated plate which directs heat toward the element; and guide flaps for positioning the element within the heated chamber such that the element is heated uniformly heated along the length of the element by the heating means.

29. An apparatus according to claim 28, wherein the transporting means is a plurality of rollers which contact the element when the element is within the heated chamber.

30. An apparatus according to claim 29, wherein the guide flaps bias the element toward at least one of the plurality of rollers.

31. An apparatus according to claim 28, wherein the transporting means causes the element to travel along a relatively straight path.

32. An apparatus according to claim 28, wherein the transporting means caused the element to travel along a path as one of a serpentine shape, an arched path, and a straight path.

* * * * *